US008425177B2

(12) United States Patent
Tucker

(10) Patent No.: US 8,425,177 B2
(45) Date of Patent: Apr. 23, 2013

(54) COMPACT REFUSE CART LIFTER WITH ROTATING LATCH

(75) Inventor: Charles Tyler Tucker, Greer, SC (US)

(73) Assignee: Delaware Capital Formation, Inc., Wilmington, DE (US)

( * ) Notice: Subject to any disclaimer, the term of this patent is extended or adjusted under 35 U.S.C. 154(b) by 212 days.

(21) Appl. No.: 12/941,782

(22) Filed: Nov. 8, 2010

(65) Prior Publication Data

US 2011/0052355 A1 Mar. 3, 2011

Related U.S. Application Data

(63) Continuation of application No. 12/115,354, filed on May 5, 2008, now Pat. No. 7,845, 893.

(60) Provisional application No. 60/915,849, filed on May 3, 2007.

(51) Int. Cl.
*B65F 3/02* (2006.01)

(52) U.S. Cl.
USPC ..... 414/810; 414/408

(58) Field of Classification Search ..... 414/408, 414/421, 810
See application file for complete search history.

(56) References Cited

U.S. PATENT DOCUMENTS

| | | | | | |
|---|---|---|---|---|---|
| 3,804,277 | A * | 4/1974 | Brown et al. | ..... | 414/303 |
| 4,773,812 | A * | 9/1988 | Bayne et al. | ..... | 414/408 |
| 5,024,573 | A * | 6/1991 | Redding et al. | ..... | 414/408 |
| 5,026,241 | A * | 6/1991 | Wyman | ..... | 414/303 |
| 5,069,593 | A * | 12/1991 | Zelinka et al. | ..... | 414/408 |
| 5,447,405 | A * | 9/1995 | Bayne et al. | ..... | 414/408 |
| 5,466,110 | A * | 11/1995 | Redding | ..... | 414/421 |
| 5,772,385 | A * | 6/1998 | Huntoon et al. | ..... | 414/408 |
| 6,551,046 | B1 * | 4/2003 | Dorrington | ..... | 414/408 |
| 6,884,017 | B2 * | 4/2005 | Arrez et al. | ..... | 414/408 |
| 7,128,515 | B2 * | 10/2006 | Arrez et al. | ..... | 414/408 |
| 7,806,645 | B2 * | 10/2010 | Arrez et al. | ..... | 414/408 |
| 2002/0141854 | A1 * | 10/2002 | Arrez et al. | ..... | 414/408 |
| 2003/0053895 | A1 * | 3/2003 | Schrafel | ..... | 414/408 |
| 2006/0045681 | A1 * | 3/2006 | Bayne et al. | ..... | 414/408 |

* cited by examiner

*Primary Examiner* — James Keenan
(74) *Attorney, Agent, or Firm* — McAndrews, Held & Malloy, Ltd.

(57) ABSTRACT

A compact lifter is disclosed which allows for an improved operating envelope of the liftplate. The lifter utilizes a motor having 210 degrees of rotation and lifting arms of a unique geometry to rotate a liftplate from a retracted position below and in front of the lifter baseplate to a dumping position wherein the opening of a refuse cart is located substantially forward of an inner hopper or container edge. As a result, refuse is dumped further into the container or vehicle hopper, which minimizes the number of packing cycles required as multiple refuse carts are emptied. The liftplate is attached to the motor using dual lifting arms, and includes a fixed upper hook. A rotating, retractable lower hooking mechanism holds the refuse cart during dumping. The compact design improves ground clearance when the lifter is retracted, permits the dumping of large commercial containers over the lifter, and requires no modification of the hopper structure of a rear-loading refuse collection vehicle. The lifter may be mounted over a wide range of mounting heights and maintain engagement with refuse carts without altering the structural components of the lifter.

7 Claims, 23 Drawing Sheets

COMPACT REFUSE CART LIFTER WITH ROTATING LATCH

RELATED APPLICATIONS

This application is a continuation of U.S. patent application Ser. No. 12/115,354, entitled "Compact Refuse Cart Lifter With Rotating Latch" filed May 5, 2008, which in turn makes reference to, claims priority to, and claims the benefit of U.S. Provisional Patent Application Ser. No. 60/915,849, entitled "Compact Refuse Cart Lifter With Rotating Latch", filed May 3, 2007, the complete subject matter of which was incorporated herein by reference, in its entirety.

FEDERALLY SPONSORED RESEARCH OR DEVELOPMENT

[Not Applicable]

MICROFICHE/COPYRIGHT REFERENCE

[Not Applicable]

BACKGROUND OF THE INVENTION

The present invention relates to refuse container lifting devices, and in particular to refuse cart lifting devices. Refuse containers are often quite heavy, and therefore refuse collection vehicles are generally equipped with refuse container lifting devices to assist the vehicle operator when emptying the refuse containers. However, a refuse collection vehicle may encounter several different types of refuse containers on a given collection route, and the differences in these refuse containers often require the use of separate lifting devices. For example, large commercial refuse containers, or dumpsters, are typically emptied by tipping the container over the edge of the vehicle hopper using a variety of lifting devices, including tipper bars and cable and winch arrangements.

Refuse carts are relatively light refuse receptacles constructed from various plastics and other synthetic materials. Features of refuse carts may include for example hinged covers, locking covers, wheels, and handles in various locations and configurations. Capacities generally range from, for example, 30 gallons to 95 gallons. Refuse carts typically encountered in residential areas are emptied using a refuse cart lifter capable of engaging the refuse cart, lifting it, and inverting the refuse cart to empty refuse into the vehicle hopper.

Many prior refuse cart lifters presented a wide profile and thus protrude from the refuse collection vehicle so as to interfere with the emptying of commercial dumpsters when they are tipped over the edge of the vehicle hopper. Protruding cart lifters also created a hazard for the rear-loading refuse collection vehicle driver when backing up, and the side-loading refuse collection driver when navigating narrow roadways, such as alleys. Some lifter designs have addressed this problem by locating the lifter off to the side of or even completely beneath the refuse collection vehicle hopper. Others attempted to reduce the profile of the refuse cart lifter to address the lifter protrusion issue.

Another problem in the refuse cart lifter industry is that cart lifters typically hang down from the refuse collection vehicle, and therefore reduce the vehicle's ground clearance, particularly on uneven ground. Due to the increased distance of a rear-loading refuse collection vehicle from the rear wheels to the most rearward hopper edge, this part of the hopper regularly makes contact with the ground on uneven terrain. Thus, some lifter designs include a retracted position where the lifter is angled underneath the refuse collection vehicle hopper, rather than hanging straight down. However, this type of design may cause interference with light bars and other structural components of the vehicle hopper. Moreover, these angled designs are not suitable for mounting to flat-walled receptacles, such as intermediate containers. Thus, a refuse cart lifter that retracts to a compact profile and keeps all components forward of the mounting surface would serve to improve the operational ground clearance when mounted on a vehicle, and eliminate costly mounting modifications on vehicles or refuse containers.

Most refuse cart lifters used with rear-loading refuse collection vehicles where ground clearance is of great importance are designed with sliding lower hook mechanisms. These sliding mechanisms retract to decrease the side profile length of the refuse cart lifter in the retracted position. However, sliding mechanisms have an increased susceptibility to contaminants that increase wear and maintenance compared to rotating mechanisms. Thus, a refuse cart lifter designed with increased ground clearance with a rotating lower hook mechanism would decrease maintenance and cost.

Yet another issue involves refuse compaction cycles. Prior cart lifters continuously dump refuse into the portion of the vehicle hopper closest to the refuse cart lifter because these lifters cannot empty the refuse cart a substantial distance into the hopper when dumping. The refuse therefore quickly accumulates near the refuse cart lifter, which requires the vehicle operator to stop collecting carts and compact the refuse to prevent interference with the next lifter dumping cycle. Thus, a lifter that empties refuse carts further into the refuse collection vehicle hopper would decrease the amount of time and energy spent compacting refuse between refuse cart dumping.

A final issue involves maintenance of the lifter. Elevated hydraulic loads associated with some lifters correspond to increased wear and strain on cart lifter systems. Also, some lifter motor designs are readily susceptible to damage from contaminants present in the hydraulic system and eventually require complex repairs or rebuilding that can typically only be performed at the manufacturer's facility. Finally, many lifters use bearings that require regular greasing.

Thus, a need exists in the refuse collection industry for a residential refuse cart lifter that possesses a slim profile, provides improved ground clearance, decreases the amount of time and energy spent compacting refuse between the emptying of successive refuse carts, provides needed lifting capacity at lower hydraulic pressures, requires little maintenance, and is easy to repair or rebuild at the end user's facility.

SUMMARY OF THE INVENTION

The present invention relates to a refuse cart lifter that allows for an improved operating envelope of the liftplate. The improved operating envelope results from a wide range of rotation of the liftplate in combination with a unique lifting arm design. This yields a refuse cart lifter that is capable of being retracted when not in use for increased ground clearance, while dumping refuse further into the refuse collection vehicle hopper than prior lifters. This added dumping range increases the efficiency of refuse collection because a vehicle operator does not have to operate the vehicle's packing blade as frequently, resulting in savings in time and energy.

The presently preferred version of the refuse cart lifter utilizes a motor to rotate a lifting arm and liftplate 210 degrees for the purpose of dumping refuse containers into a receptacle. It is preferable to use a dual rack and single pinion hydraulically actuated unit as the motor due to its thin profile and superior lifting capacity at lower hydraulic pressures. This motor design also is preferable due to its open gear design, which makes it less susceptible to damage from contaminants in the hydraulic fluid system, and for the ease with which the lifter can be repaired or rebuilt at the end users facility. This actuator is based on the same design disclosed in U.S. Pat. No. 4,773,812, which is hereby incorporated by reference.

The liftplate is attached to the motor using two lifting arms capable of directing the liftplate substantially forward into the vehicle hopper when used with a motor having a wide range of rotation. The liftplate has one fixed saddle, and the lifter employs a unique rotating lower hook mechanism. This new design allows the lifter to be more compact in its home (retracted) position and improves ground clearance when mounted on the rear of a rear loaded refuse collection vehicle.

Other design features include the use of composite materials in all bearing areas to make the unit more maintenance free by eliminating the need for regular greasing. Also, longer lifting and latch arms may be utilized to allow for mounting the lifter on the side of a side-loading refuse collection vehicle.

The present liftplate does not extend underneath the refuse collection vehicle in the retracted position, and therefore does not require modification of the hopper structural components. The slim profile of the lifter motor and the retracted position of the liftplate function to preclude interference with the dumping of large commercial containers over the lifter. Optionally, thin bumpers may be mounted to the vehicle to protect the lifter as large commercial containers are dumped into the hopper.

In addition to its compact profile and improved ground clearance, the present refuse cart lifter provides a sweeping motion of the liftplate that permits engagement of the saddle with the upper lifting point of a refuse cart over a wide range of mounting heights. While some previous lifters provided for up to a plus or minus one-inch range of mounting heights, the present refuse cart lifter may include a mounting height range of up to plus or minus four-inches. Significantly, the improved mounting height range is achieved without the use of alternate arm attachment points or the substitution of arms having a different length or geometry.

To empty a residential refuse cart into the hopper of the refuse collection vehicle, the lifter commences an emptying cycle. During the emptying cycle, the lifter motor rotates the liftplate from a retracted position to an intermediate position such that a fixed saddle engages the refuse cart. As the lifter continues to rotate, the cart is lifted in a sweeping arc motion towards the hopper. Meanwhile, a rotating hook mechanism gradually engages a lower lifting point on the refuse cart to prevent the loss of the cart into the hopper as the cart is emptied. At the end of the emptying cycle the lifter is in the dumping position, and the opening of the refuse cart is positioned significantly forward into the hopper such that the cycling of the packer blade is reduced.

An unloading cycle reverses the emptying cycle and the cart is brought back down to street level in a sweeping arc motion. As the cart descends, the rotating hook mechanism gradually disengages the lower lifting point on the refuse cart, followed by the disengagement of the saddle from the upper lifting point on the refuse cart after the refuse cart reaches the ground. The lifter can then be rotated further until the liftplate returns to the refracted position.

BRIEF DESCRIPTION OF SEVERAL VIEWS OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION OF THE INVENTION

Figure 1:
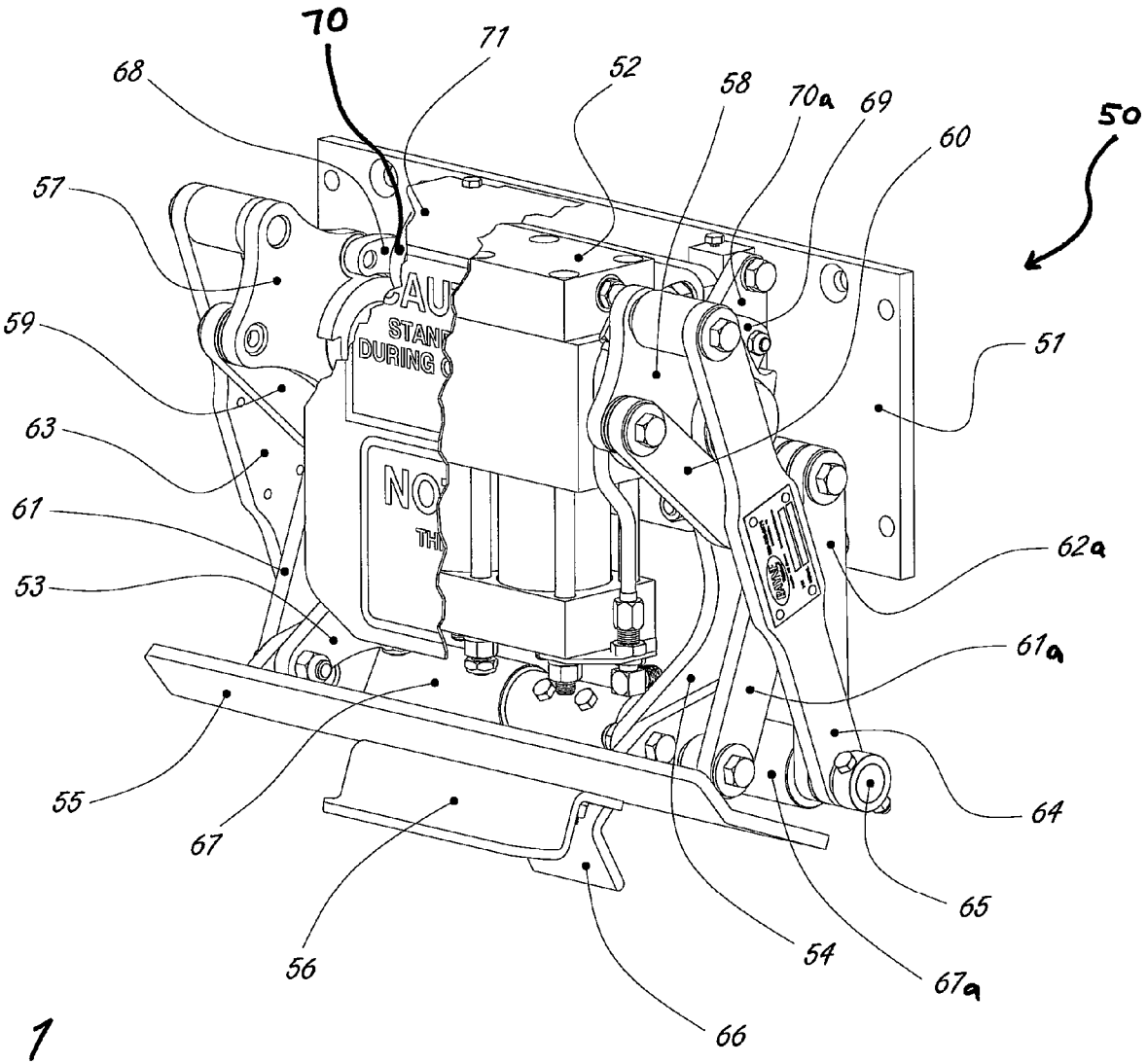
FIG. 1 is a partially cut away perspective view of an exemplary refuse cart lifter in accordance with the present invention shown in a retracted position.

FIG. 1 depicts a preferred embodiment of the present refuse cart lifter 50 shown in a retracted position. The motor 52 is affixed to the front side of the baseplate 51, and shrouded by cover 71. The motor depicted is a dual rack, single pinion hydraulic actuator capable of 210 degrees of rotation. The rear side 51*a* of baseplate 51 can be attached to a refuse collection vehicle or a large refuse collection container. Left and right lifting arms 53 and 54, respectively, are attached at a first end to the rotatable shaft (not shown) of motor 52. The second end of left and right lifting arms 53 and 54 are attached to the liftplate 55. In this view, the inner surface of saddle 56 is clearly visible.

The left pivotplate 57 is pivotally mounted over the pinion hub of the left lifting arm 53. The right pivotplate 58 is pivotally mounted over the pinion hub of the right lifting arm 54. The left and right pivotplates 57 and 58 are able to pivot independently of the lifting arms 53 and 54. The left and right locks 68 and 69, respectively, are pivotally attached at a first end to the inner surface of the pivotplates 57 and 58. Cam followers connected to the second end of left and right locks 68 and 69 ride inside a slot of the left and right driveplates 70 and 70*a*, respectively.

The left idler 59 is pivotally attached at a first end to the outer surface of the left pivotplate 57. The right idler 60 is pivotally attached at a first end to the outer surface of the right pivotplate 58. The left and right pull arms 61 and 61*a*, respectively, are pivotally attached at a first end to the liftplate 55. The second end of left and right pull arms 61 and 61*a* are pivotally attached to the second end of left and right idlers 59 and 60, respectively. The left and right push arms 62 (not shown) and 62*a*, respectively, are pivotally attached at a first end to the left and right idlers 59 and 60. The second end of the left and right push arms 62 (not shown) and 62*a* are pivotally attached to shaft 65.

Figure 2:
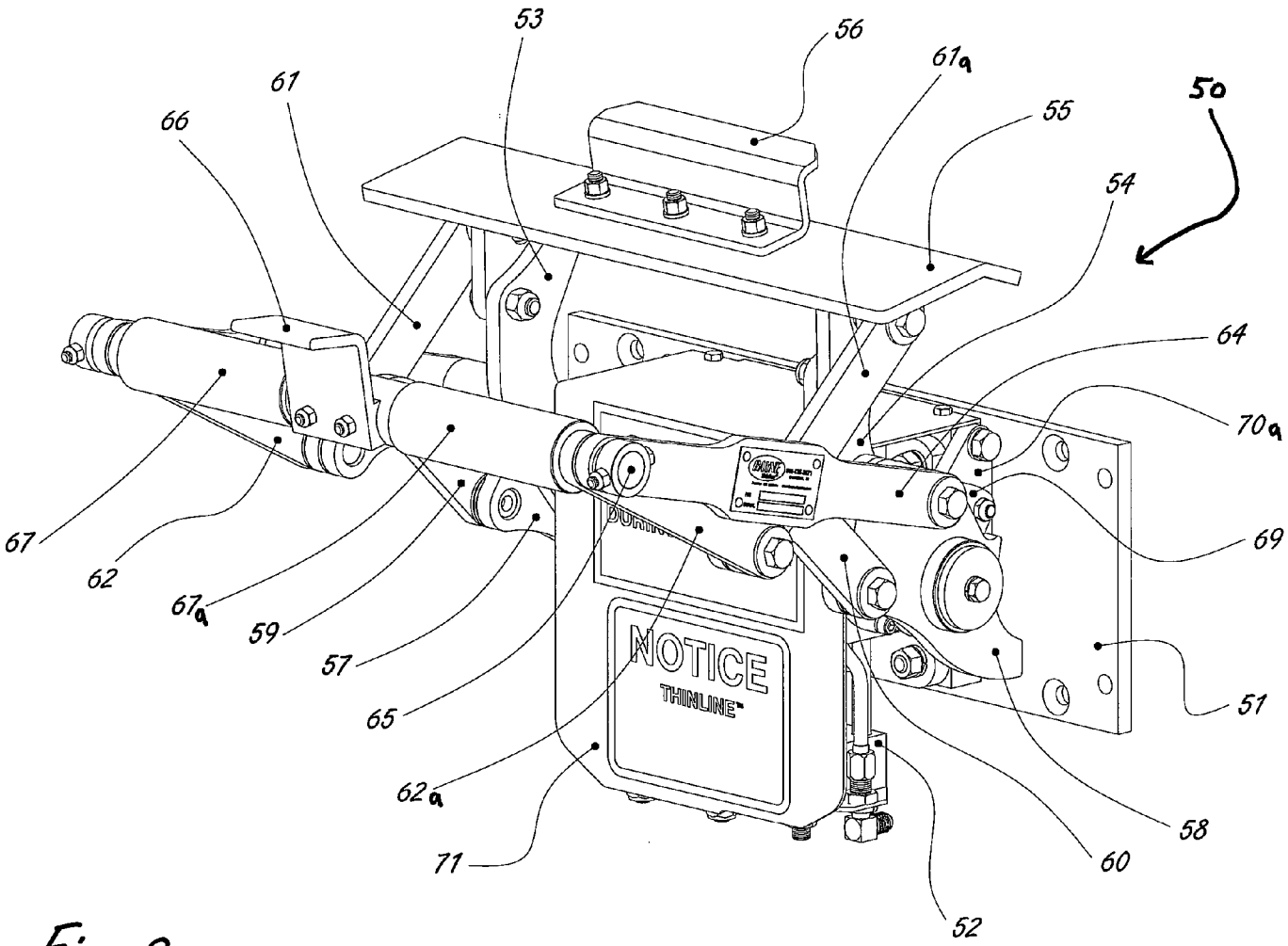
FIG. 2 is a perspective view of an exemplary refuse cart lifter in accordance with the present invention shown in an intermediate position.

FIG. 2 depicts a preferred embodiment of the present refuse cart lifter 50 shown in an intermediate position. In this figure, the motor 52 has rotated the dual lifting arms 53 and 54, swinging the liftplate 55 to a position rotated approximately 150 degrees from the retracted position. Note that the left and right pull arms 61 and 61*a* have also swung upwards with the liftplate 55, and rotated the left and right idlers 59 and 60 upwards. Attached to left and right idlers 59 and 60 are the left and right push arms 62 and 62*a*, which have been driven forward and upward, thus forcing left and right hook arms 63 and 64, respectively, to rotate to their outward most position.

Figure 3:
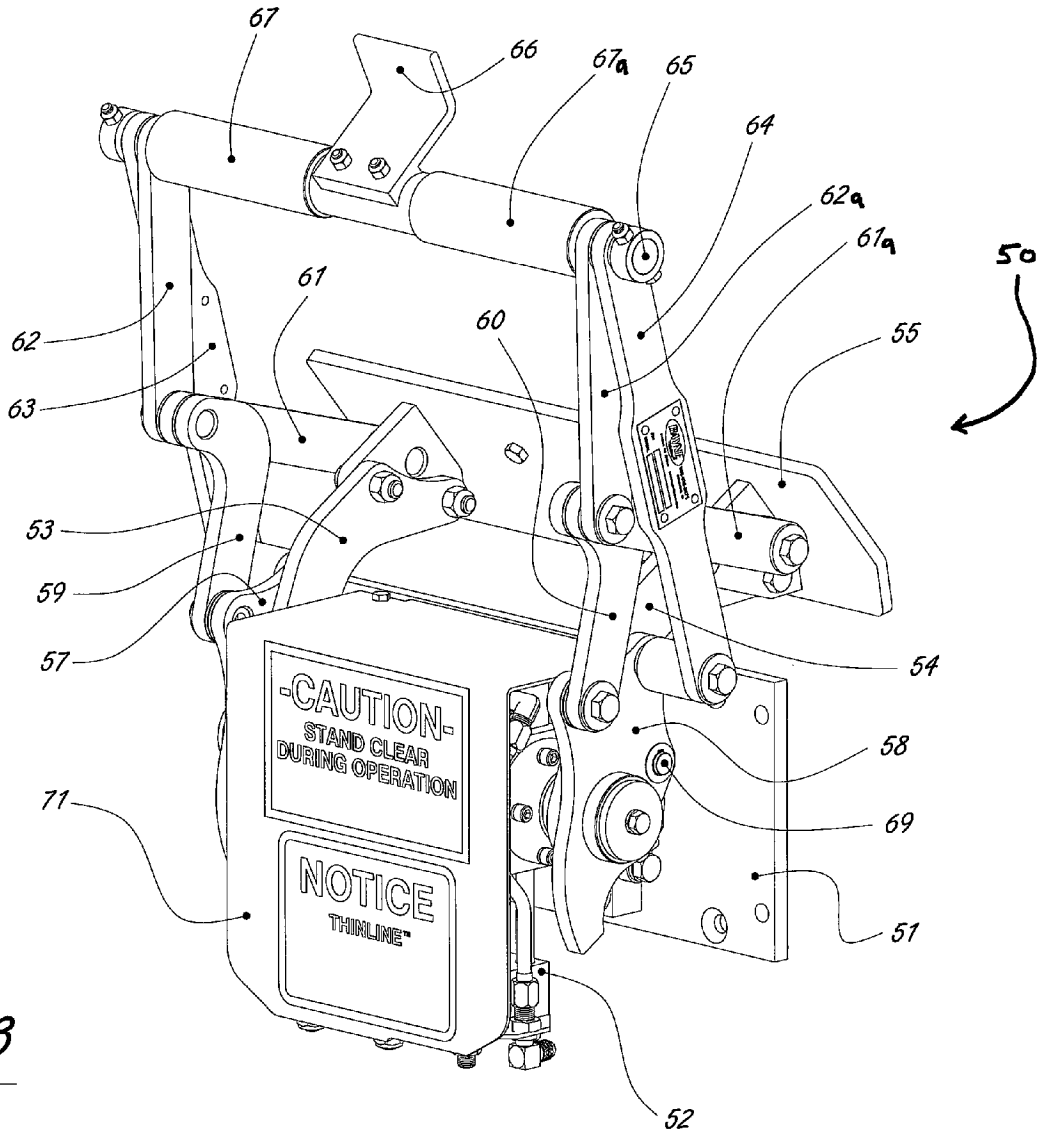
FIG. 3 is a perspective view of an exemplary refuse cart lifter in accordance with the present invention shown in a dumping position.

FIG. 3 depicts a preferred embodiment of the present refuse cart lifter 50 shown in a dumping position, which is the extreme opposite of the retracted position depicted in FIG. 1. In FIG. 3, the motor 52 has further rotated left and right lifting arms 53 and 54 past a vertical position. The resulting angle of the lifting arms 53 and 54 away from the rear side 51*a* of baseplate 51, combined with the design of left and right lifting arms 53 and 54, serves to swing liftplate 55 to a position above and substantially behind baseplate 51.

Figure 4:
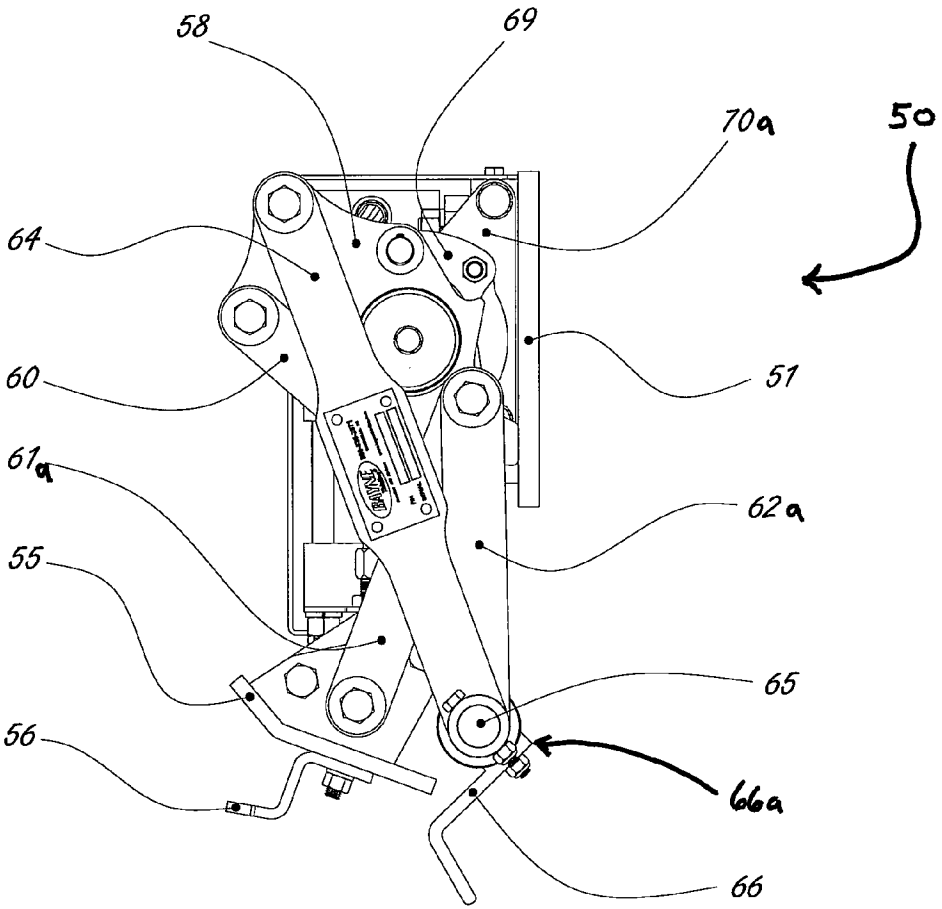
FIG. 4 is a side view of an exemplary refuse cart lifter in accordance with the present invention shown in a retracted position.
Figure 5:
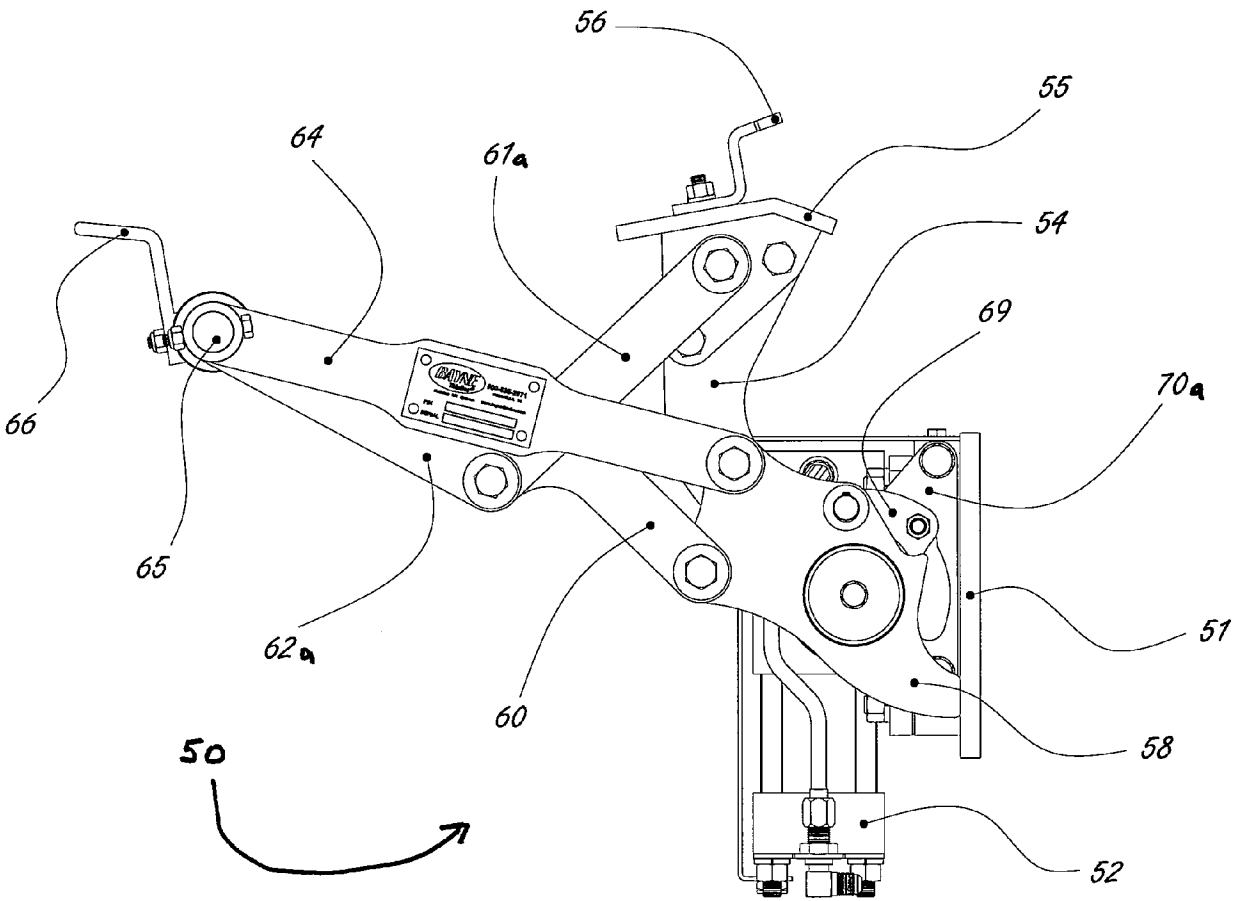
FIG. 5 is a side view of an exemplary refuse cart lifter in accordance with the present invention shown in an intermediate position.
Figure 6:
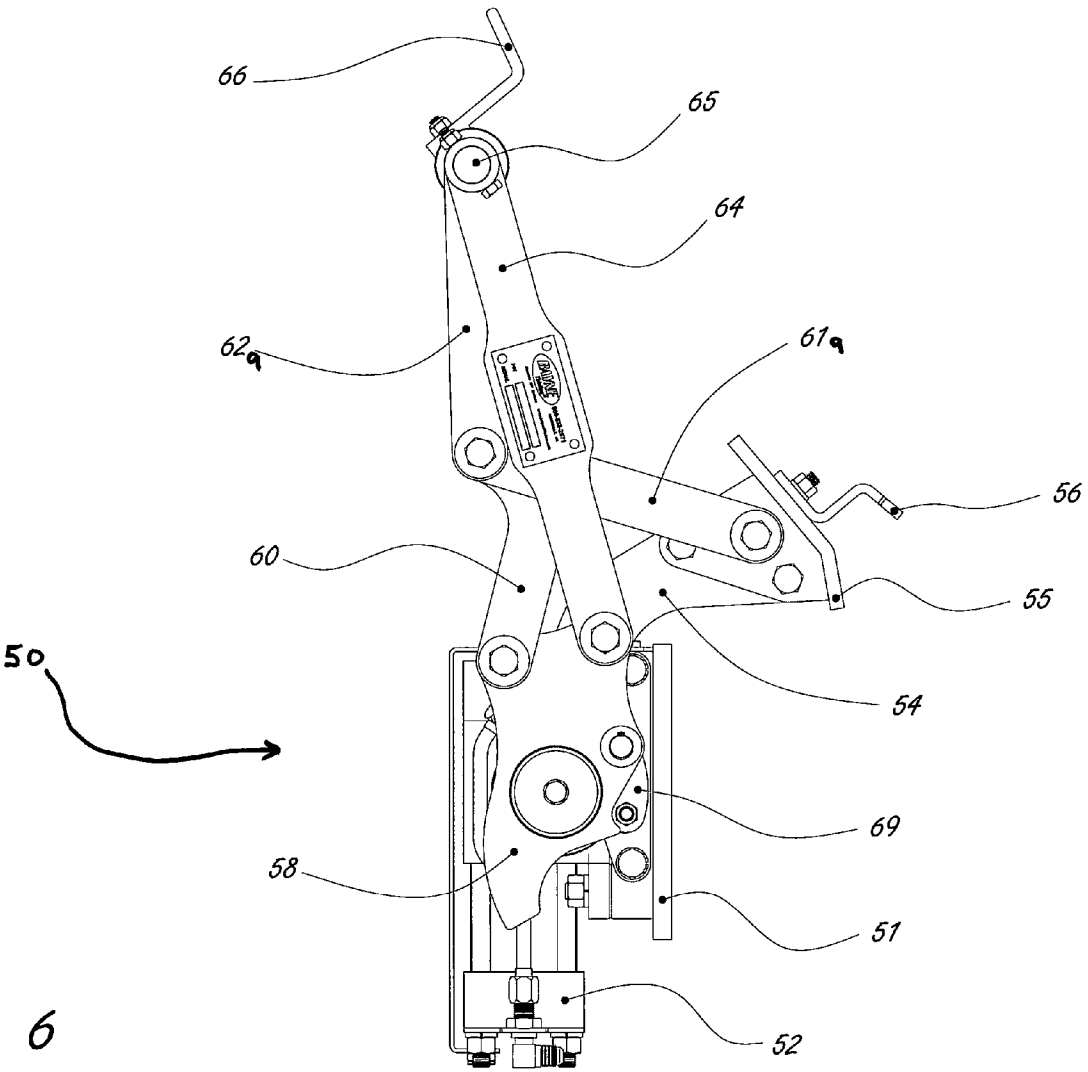
FIG. 6 is a side view of an exemplary refuse cart lifter in accordance with the present invention shown in a dumping position.

FIGS. 4 through 6 depict a side view of a preferred embodiment of the present refuse cart lifter 50 shown in the retracted, intermediate and dumping positions, respectively. FIG. 4 shows that the entire liftplate 55 and the rear edge 66*a* of the hook 66 are located below and in front of rear side 51*a* of baseplate 51 when the lifter is in the retracted position. This compact profile facilitates the emptying of large commercial refuse containers over the refuse cart lifter, thereby enhancing the versatility of the refuse collection vehicle (further discussed below with respect to FIGS. 22 and 23).

FIG. 5 depicts a side view of the preferred embodiment of the present refuse cart lifter 50 in an intermediate position. As in FIG. 2, motor 52 has rotated the left and right lifting arms 53 and 54, swinging the liftplate 55 to a position rotated approximately 150 degrees from the retracted position. At this point, left and right hook arms 63 (not shown) and 64 and hook 66 have reached their fully extended positions.

FIG. 6 depicts a side view of the preferred embodiment of the present refuse cart lifter 50 in the dumping position. Here it can be observed that the relative connection points and geometries of left and right lifting arms 53 (not shown) and 54 and left and right pivotplates 57 and 58 have caused the left and right hook arms 63 (not shown) and 64 and hook 66 to maintain their position relative to the liftplate 55 and saddle 56 from the intermediate position shown in FIG. 5 to the dumping position. As discussed in reference to FIG. 3, the unique geometry of left and right lifting arms 53 (not shown) and 54 coupled with 210 degrees rotation from the retracted position serve to position the entire liftplate 55 above and substantially behind baseplate 51. This facilitates the dumping of refuse further into the receiving refuse container than otherwise possible with conventional lifters.

Figure 7:
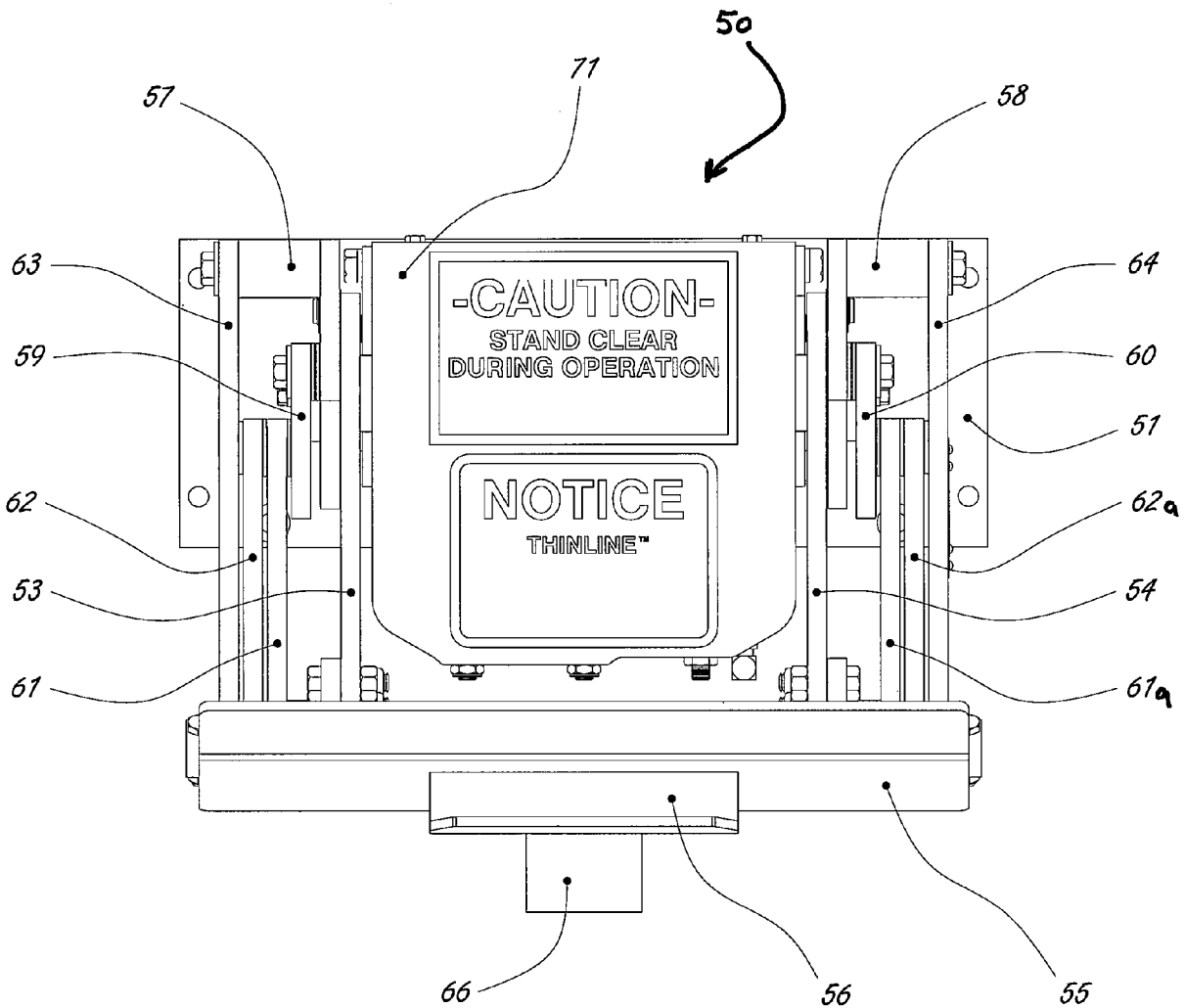
FIG. 7 is a front view of an exemplary refuse cart lifter in accordance with the present invention shown in a retracted position.

FIG. 7 depicts a front view of the preferred embodiment of the present refuse cart lifter 50 in the retracted position. This view shows the horizontal relation of left and right lift arms 53 and 54; left and right pivotplates 57 and 58; left and right idlers 59 and 60; left and right pull arms 61 and 61*a*; left and right push arms 62 and 62*a*; and left and right hook arms 63 and 64.

Figure 8:
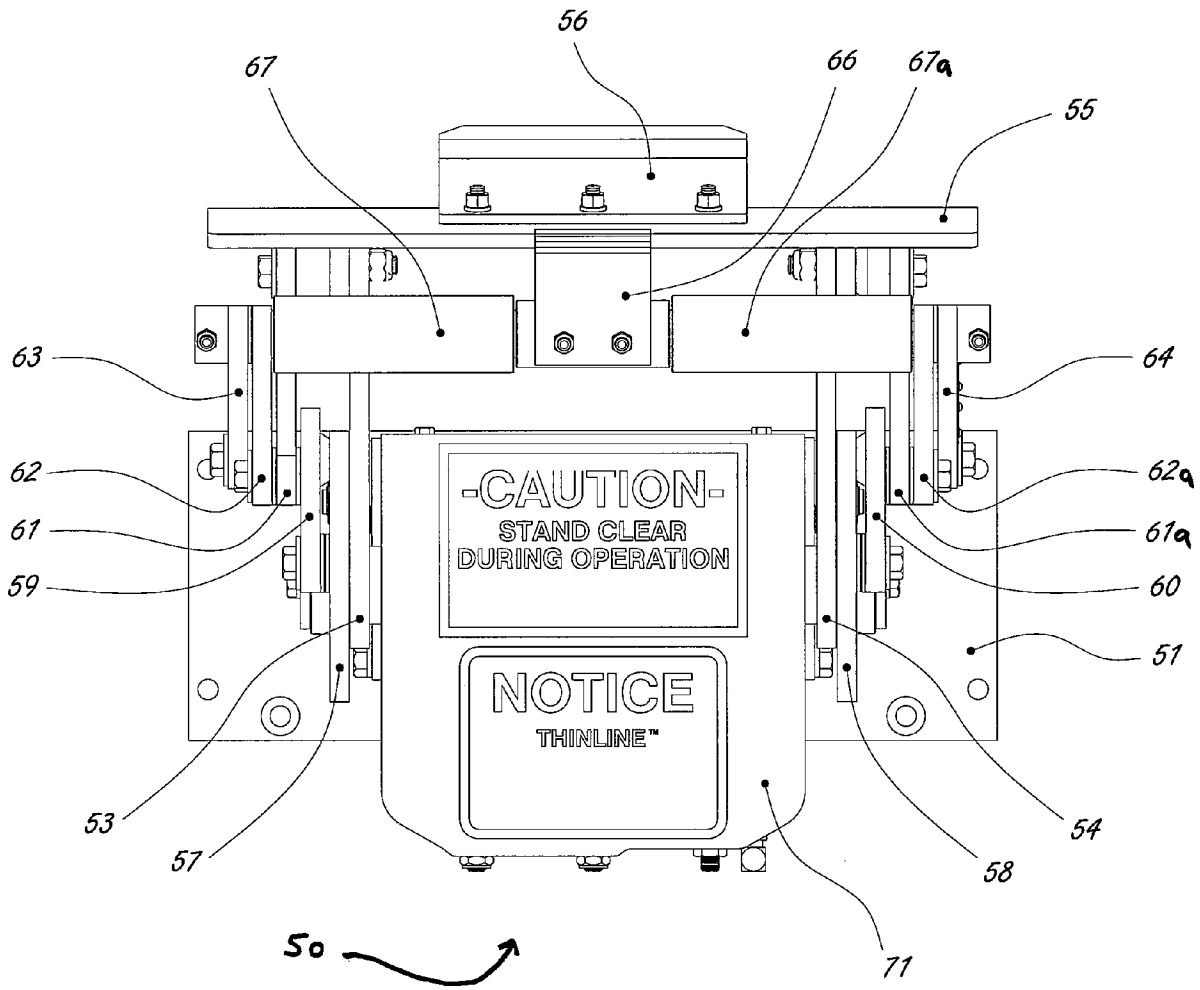
FIG. 8 is a front view of an exemplary refuse cart lifter in accordance with the present invention shown in an intermediate position.

FIG. 8 depicts a front view of the preferred embodiment of the present refuse cart lifter 50 in an intermediate position. This view shows hook 66 and left and right rollers 67 and 67*a*, respectively, positioned below the liftplate 55 and saddle 56 when fully extended.

Figure 9:
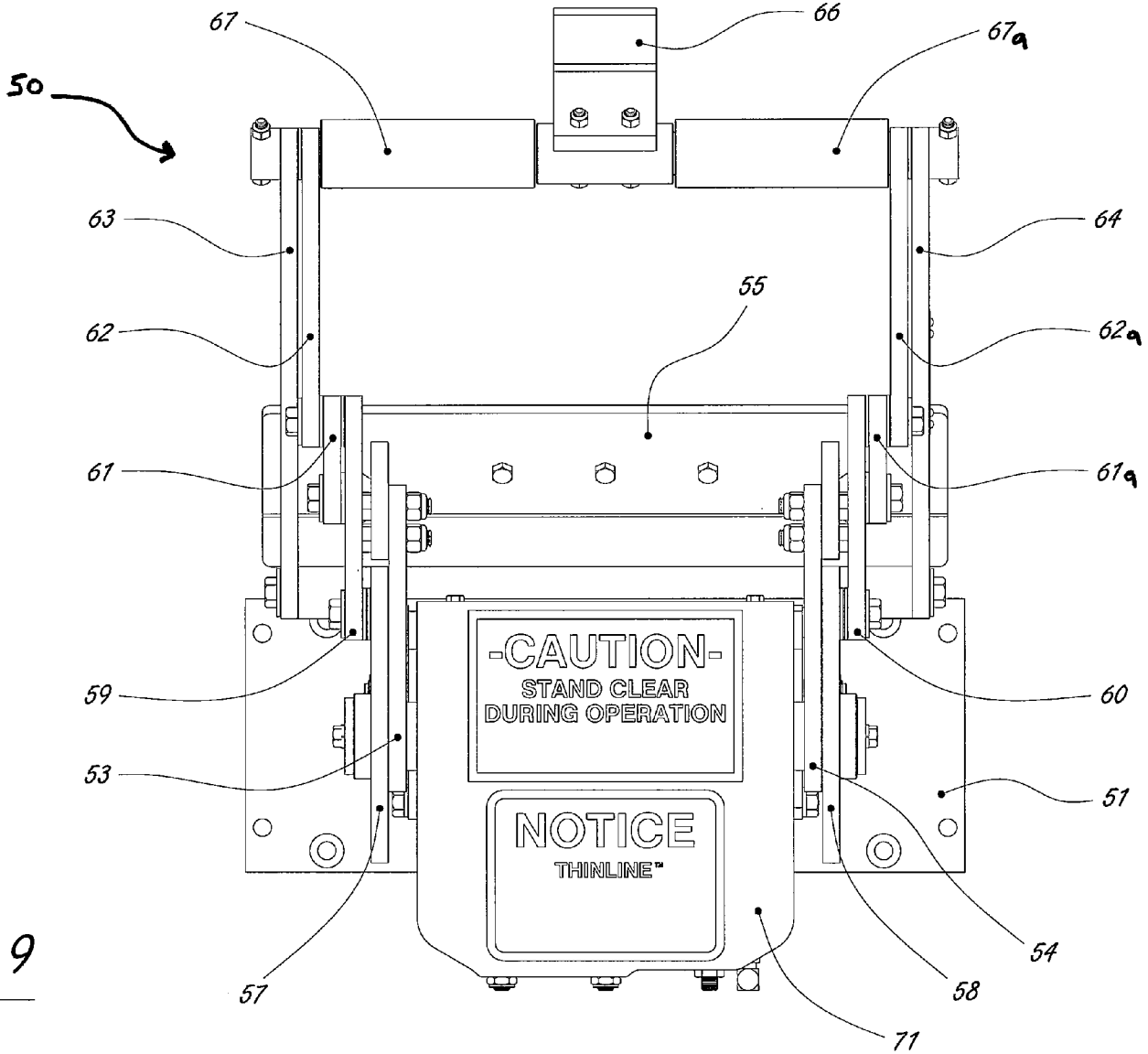
FIG. 9 is a front view of an exemplary refuse cart lifter in accordance with the present invention shown in a dumping position.

FIG. 9 depicts a front view of the preferred embodiment of the present refuse cart lifter 50 in the dumping position. This view shows the hook 66 fully extended out from the liftplate 55, and the liftplate 55 positioned above baseplate 51.

Figure 10:
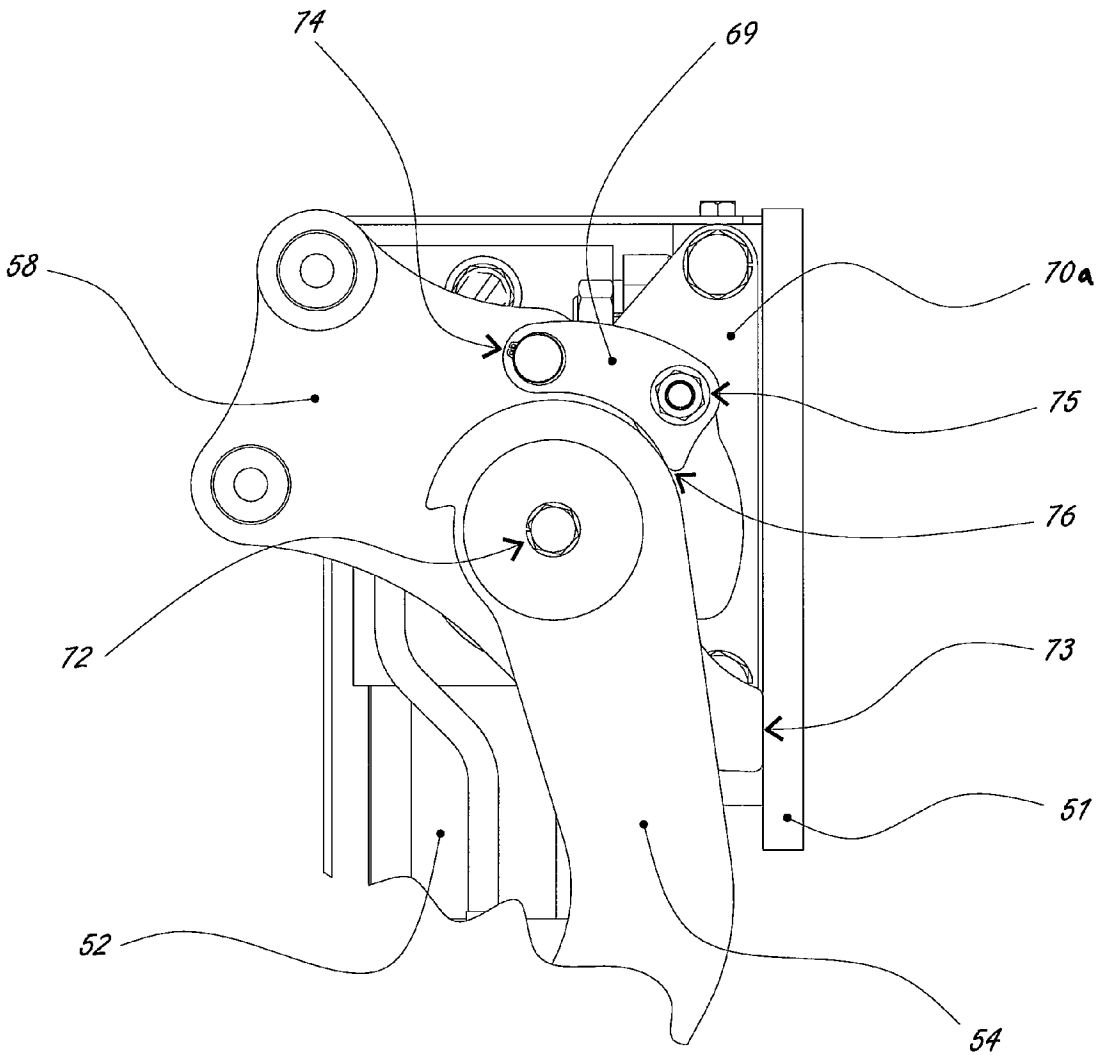
FIG. 10 is a partially cut away side view of an exemplary refuse cart lifter pivot lock system in accordance with the present invention shown in a retracted position.
Figure 11:
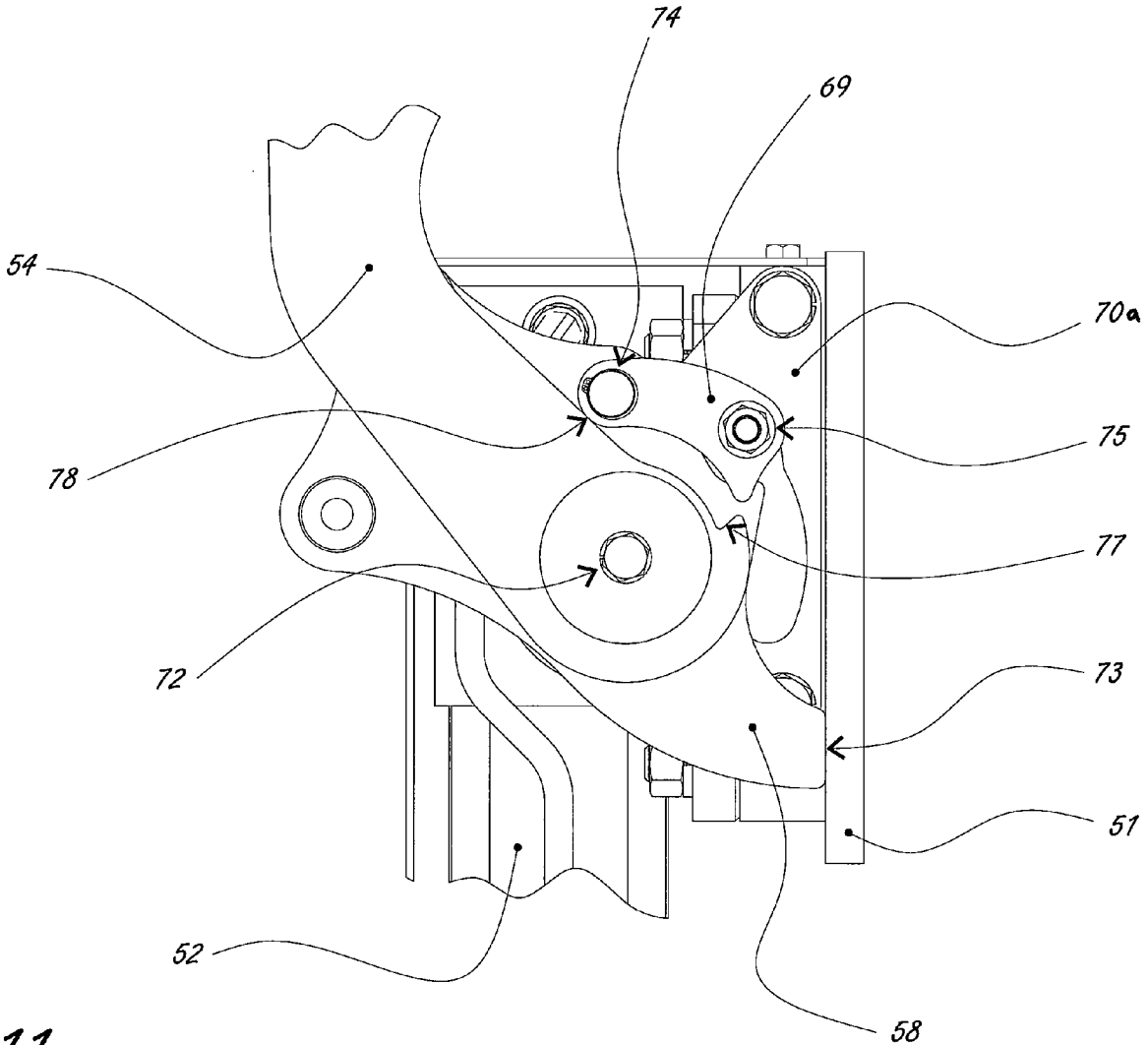
FIG. 11 is a partially cut away side view of an exemplary refuse cart lifter pivot lock system in accordance with the present invention shown in an intermediate position.
Figure 12:
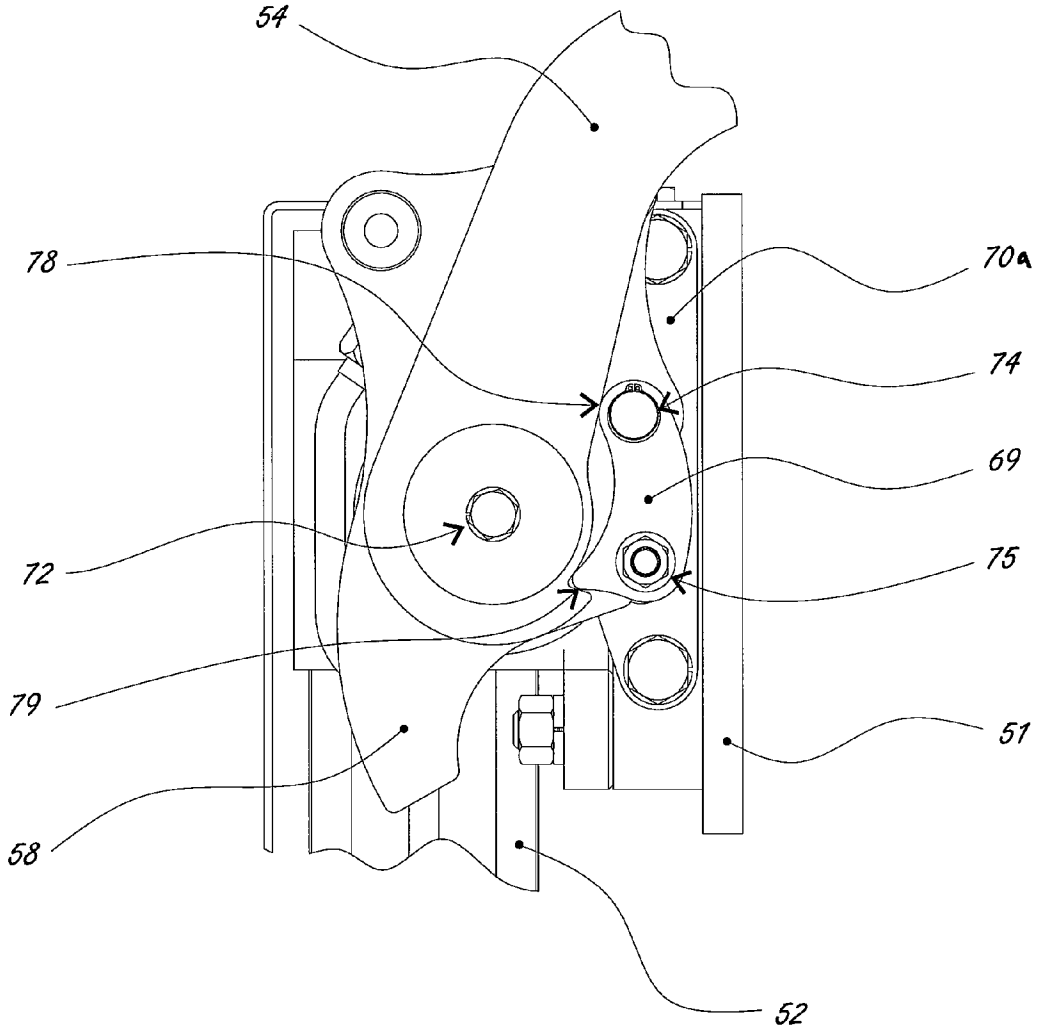
FIG. 12 is a partially cut away side view of an exemplary refuse cart lifter pivot lock system in accordance with the present invention shown in a dumping position.

FIGS. 10 through 12 show a partially cut away side view of the present refuse cart lifter 50 pivot lock system. FIG. 10 shows that in a retracted position, the right pivotplate 58 pivotally mounted on right lifting arm 54 at point 72. These are at one end prevented from rotation by contact with the baseplate 51 at point 73. A second end of right pivotplate 58 is pivotally attached to right lock 69 at point 74. The right lock 69 is held in place at a second end by a slot in the right driveplate 70*a* at point 75 and prevented from rotating by contact with right lifting arm 54 at point 76. At this point the rotation of right lifting arm 54 is independent of right pivotplate 58. Of course, the same is true for the corresponding left side (not shown) of refuse cart lifter 50.

FIG. 11 shows that in an intermediate position, the right pivotplate 58 is pivotally mounted on the right lifting arm 54 at point 72. These are at one end prevented from rotation by contact with the baseplate 51 at point 73. At a second end the right pivotplate 58 is pivotally attached to right lock 69 at point 74. The right lock 69 is held in place at a second end by a slot in right driveplate 70*a* at point 75. As right lifting arm 54 rotates to this position, right lock 69 is free to rotate down into groove 77 on right lifting arm 54. Also at this point right lifting arm 54 makes contact with right lock 69 at point 78 and begins to rotate right pivotplate 58 upward. Again, the same is true for the corresponding left side (not shown) of refuse cart lifter 50.

FIG. 12 shows that in the dumping position, right pivotplate 58 is pivotally mounted on right lifting arm 54 at point 72 and also pivotally attached to right lock 69 at point 74. The right lock is held in place at a second end by a slot in right driveplate 70*a* at point 75. The right pivotplate 58 is prevented from rotating in one direction by contact between right lock 69 and right lifting arm 54 at point 78, and in the other direction by contact between right lock 69 and right lifting arm 54 at point 79. At this point right pivotplate 58 is interlocked with right lifting arm 54. Again, the same is true for the corresponding left side (not shown) of refuse cart lifter 50.

Figure 13:
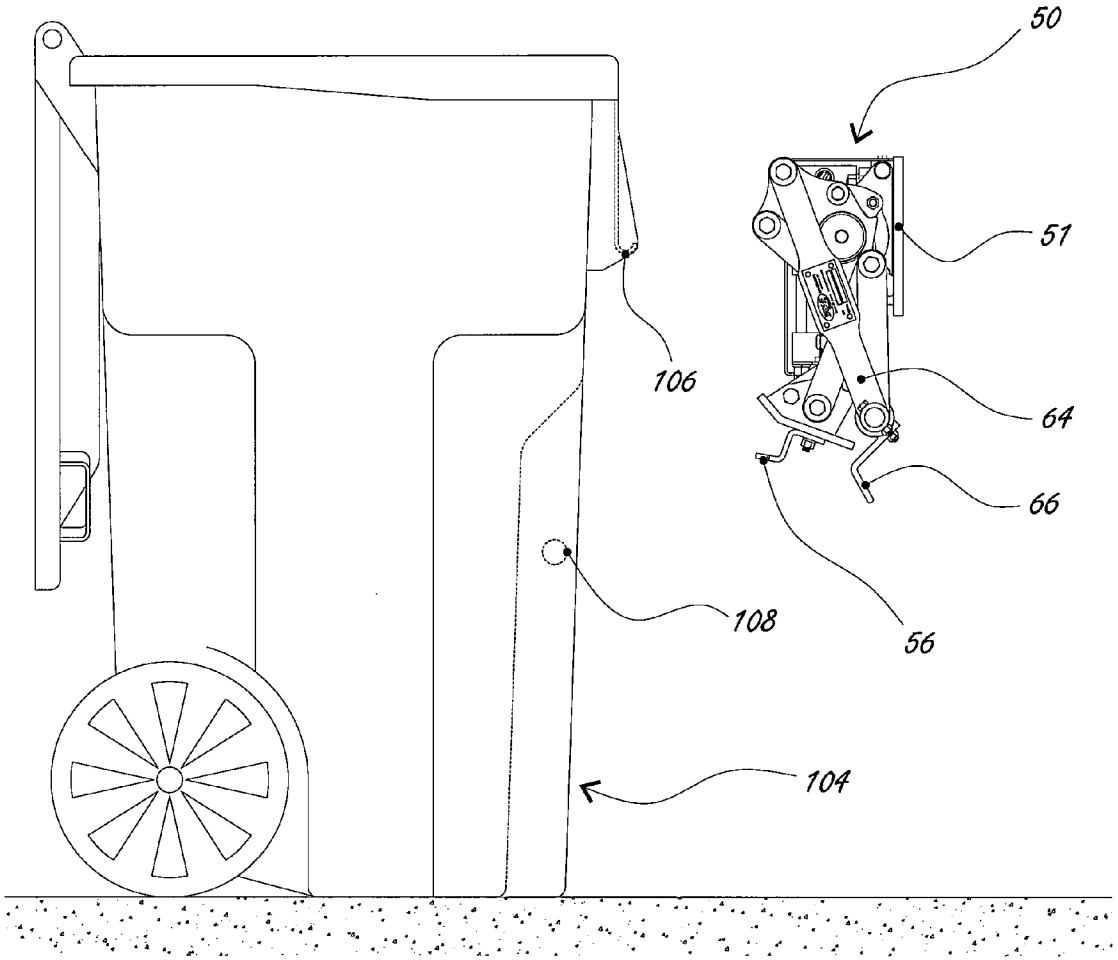
FIG. 13 is a side view of an exemplary refuse cart adjacent to a refuse cart lifter in accordance with the present invention shown in a retracted position.
Figure 14:
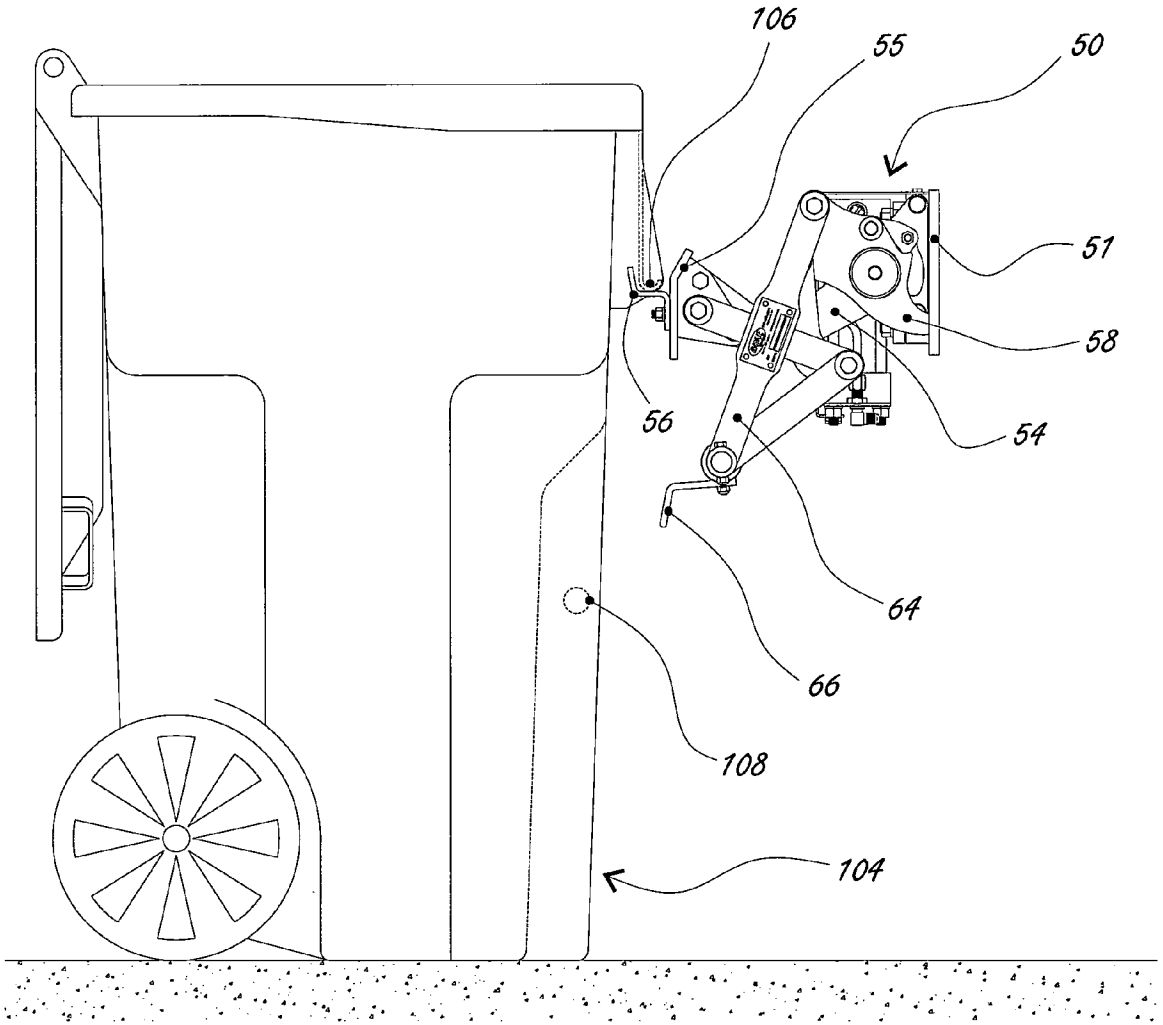
FIG. 14 is a side view of an exemplary refuse cart lifter in accordance with the present invention shown engaging the upper lifting point of an adjacent refuse cart.
Figure 15:
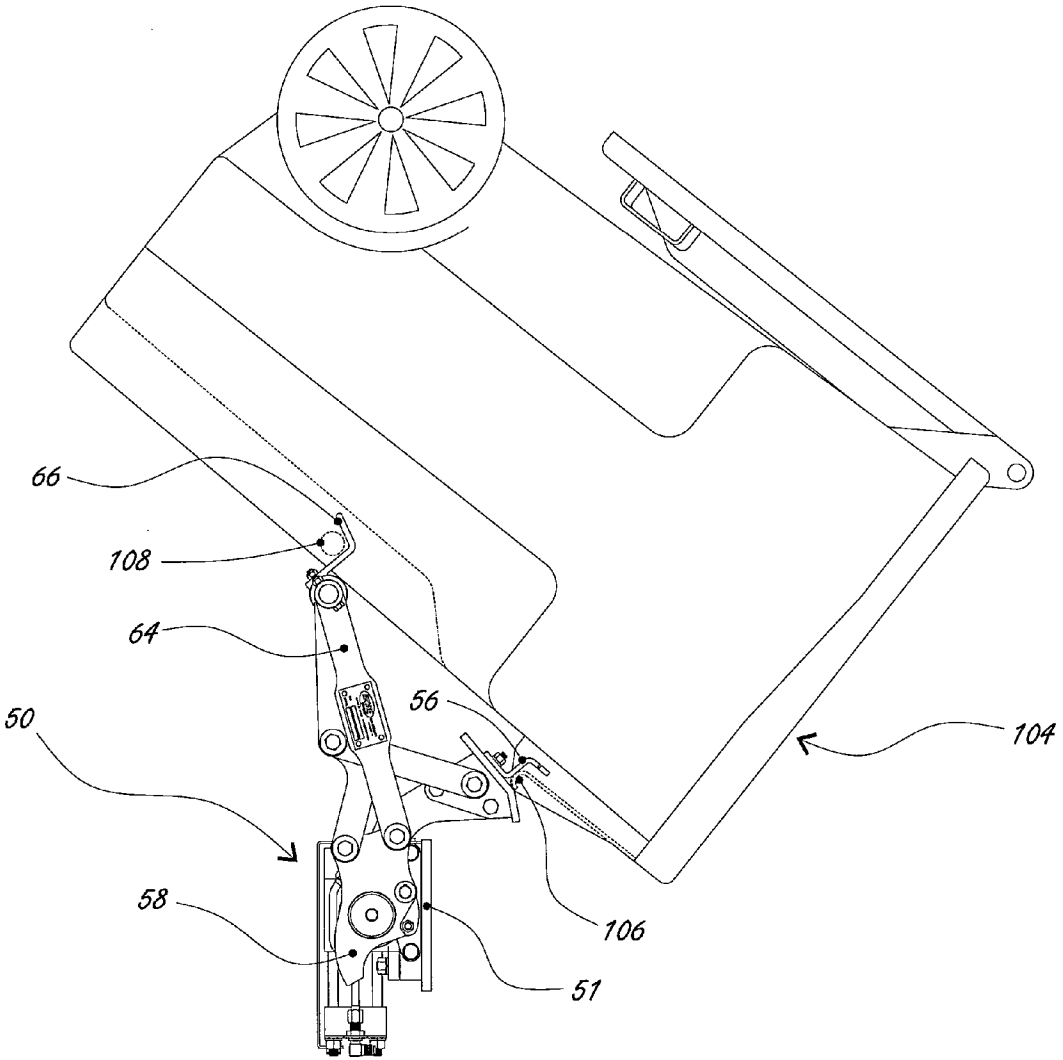
FIG. 15 is a side view of an exemplary refuse cart lifter in accordance with the present invention shown in a dumping position engaging the upper and lower lifting points of a refuse cart.

FIGS. 13 through 15 show a side view of the emptying of a refuse cart 104 using a preferred embodiment of the present refuse cart lifter 50. Initially, an operator would position a refuse cart 104 adjacent to an embodiment of the present refuse cart lifter 50, as depicted in FIG. 13. Refuse cart 104 has an upper lifting point 106 and lower lifting point 108.

Once refuse cart 104 is positioned adjacent to refuse cart lifter 50, refuse cart lifter 50 would be operated to rotate left and right lifting arms 53 (not shown) and 54 to swing the liftplate 55 up such that the saddle 56 engages refuse cart upper lifting point 106 as seen in FIG. 14. The continued operation of refuse cart lifter 50 then causes the liftplate 55 to swing over and substantially behind baseplate 51, thereby dumping refuse from the refuse cart far behind baseplate 51 as shown in FIG. 15. In addition, while the liftplate 55 is swinging from the intermediate position depicted in FIG. 14 to the emptying position shown here in FIG. 15, the relative geometries of left and right pivotplates 57 (not shown) and 58 and left and right hook arms 63 (not shown) and 64 cause hook 66 to pivot out and engage lower lifting point 108 of refuse cart 104. This prevents refuse cart 104 from falling into the refuse collection area when saddle 56 is inverted as seen in FIG. 15.

Figure 16:
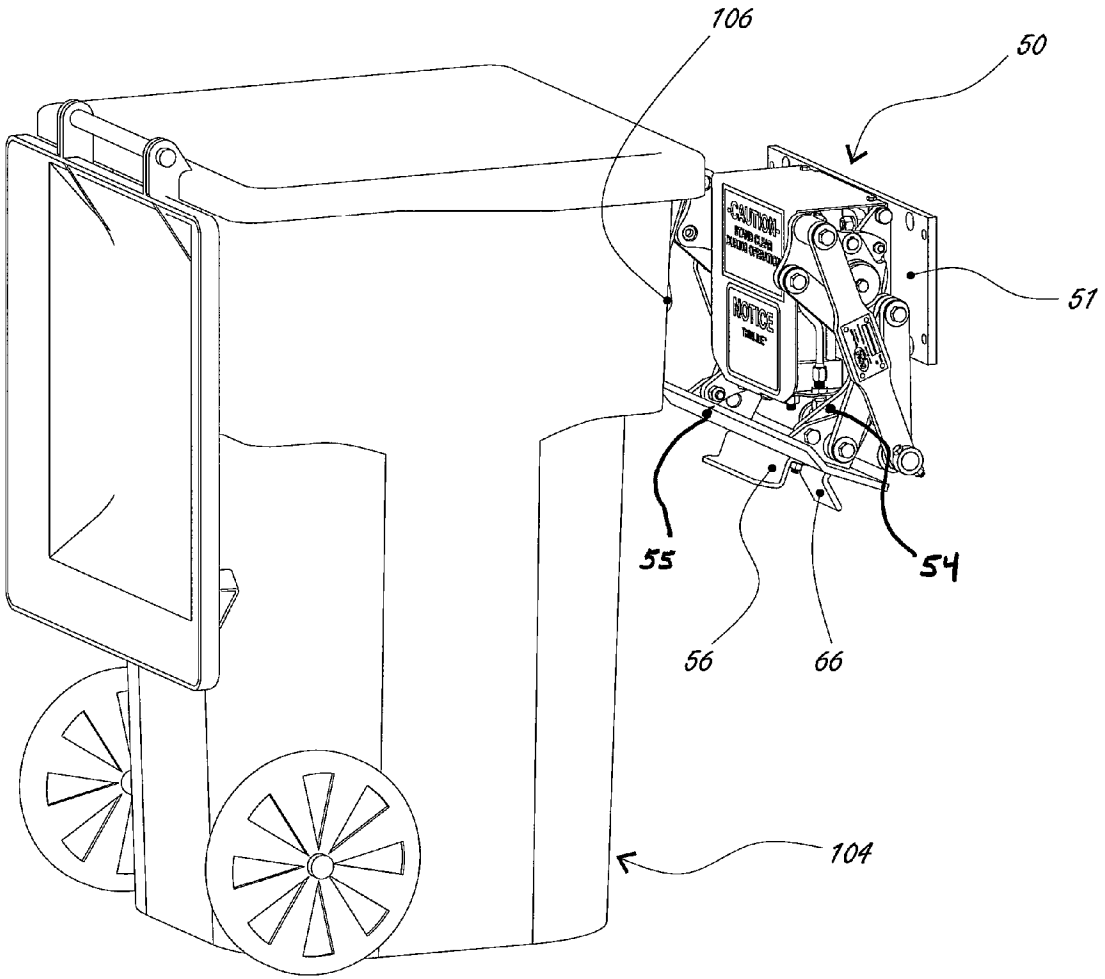
FIG. 16 is a perspective view of an exemplary refuse cart adjacent to a refuse cart lifter in accordance with the present invention shown in a retracted position.
Figure 17:
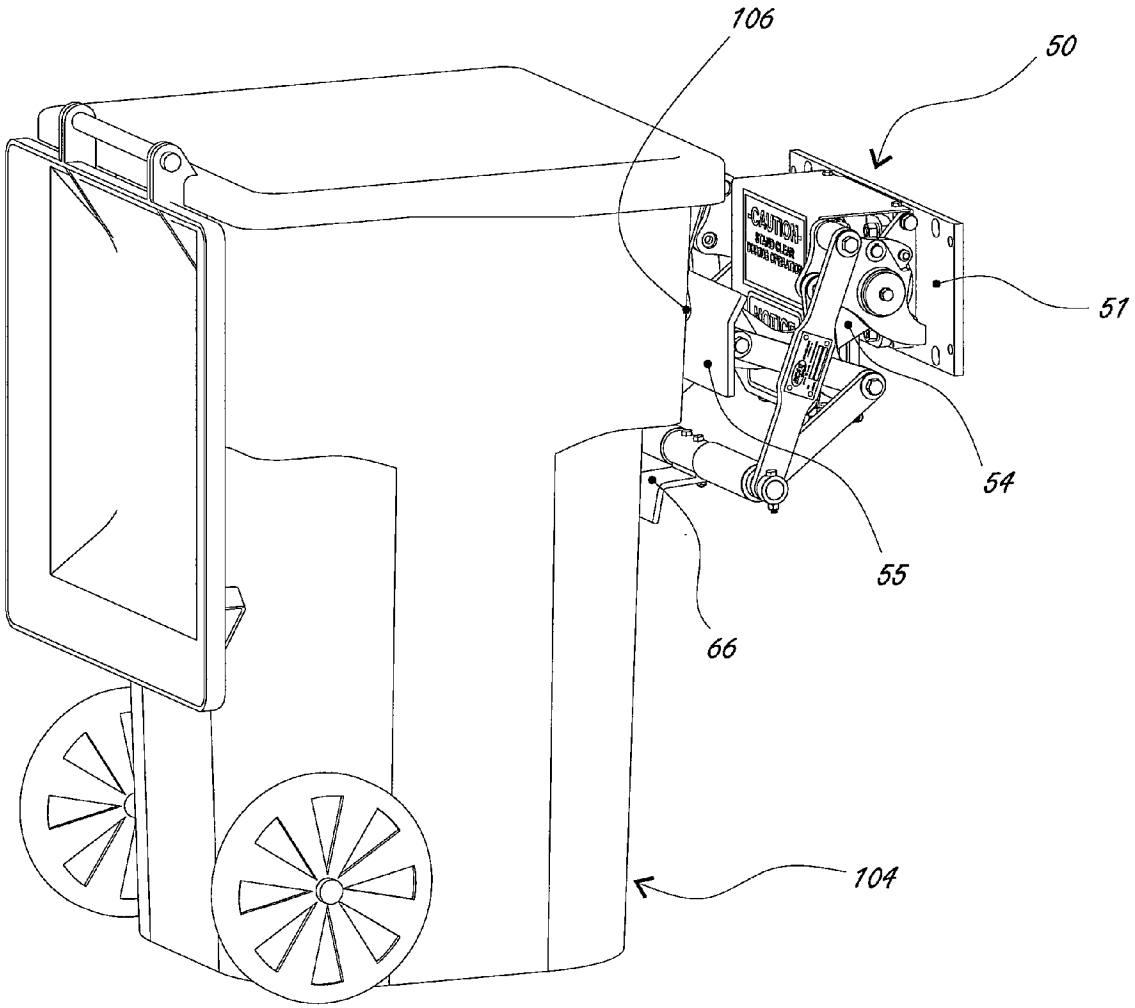
FIG. 17 is a perspective view of an exemplary refuse cart lifter in accordance with the present invention shown engaging the upper lifting point of an adjacent refuse cart.
Figure 18:
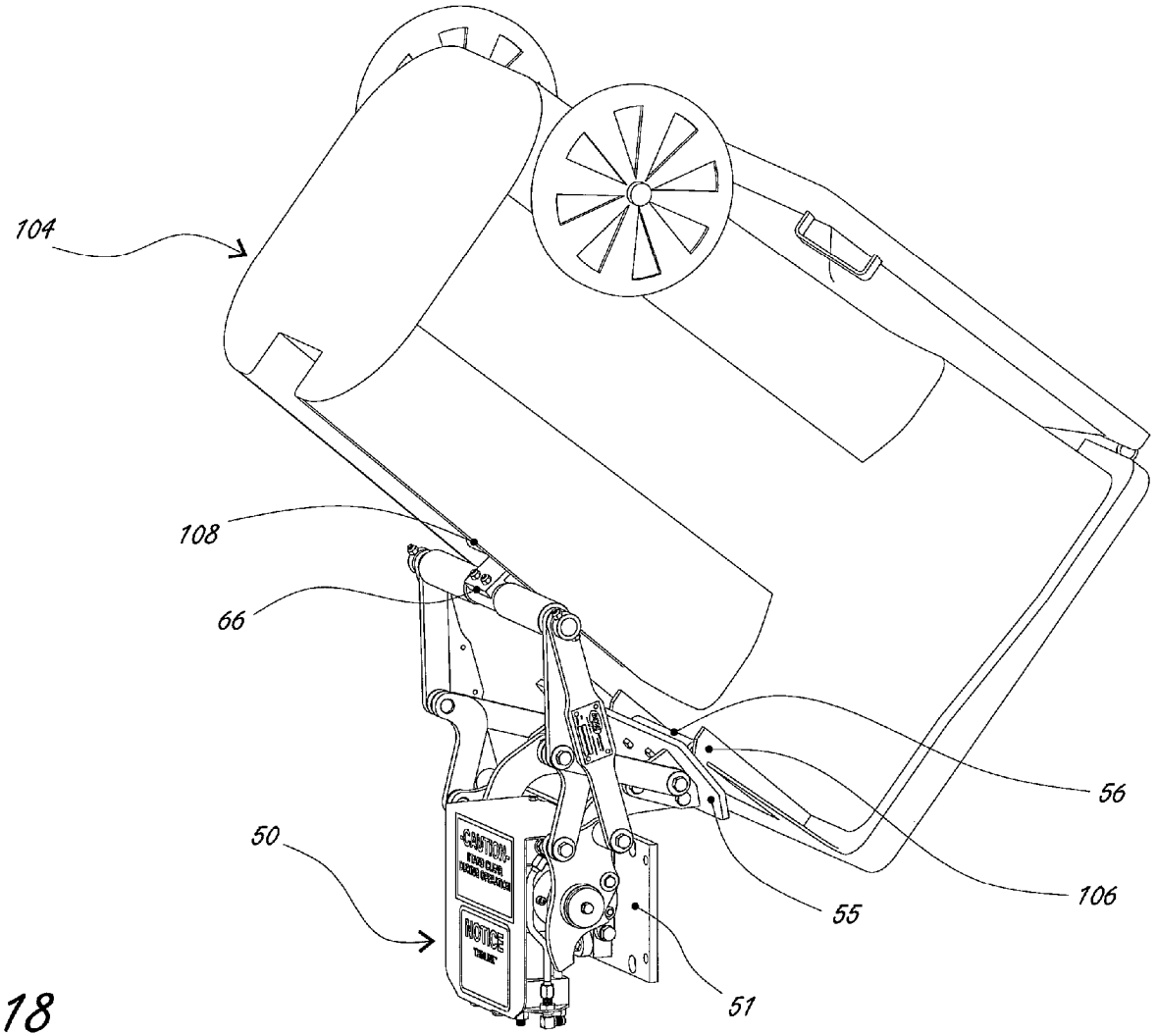
FIG. 18 is a perspective view of an exemplary refuse cart lifter in accordance with the present invention shown in a dumping position engaging the upper and lower lifting points of a refuse cart.

FIGS. 16 through 18 depict the same sequence of events as FIGS. 13 through 15, but from a perspective view. A preferred embodiment of refuse cart lifter 50 is shown in a retracted position adjacent to refuse cart 104 in FIG. 16. FIG. 17 depicts the refuse cart lifter 50 engaging upper lifting point 106 of refuse cart 104 after left and right lifting arms 53 (not shown) and 54 have swung liftplate 55 up and away from baseplate 51. Finally, FIG. 18 shows the refuse cart lifter 50 liftplate 55 swung to the dumping position with both saddle 56 and hook 66 engaging refuse cart 104 at lifting points 106 and 108, respectively.

Figure 19:
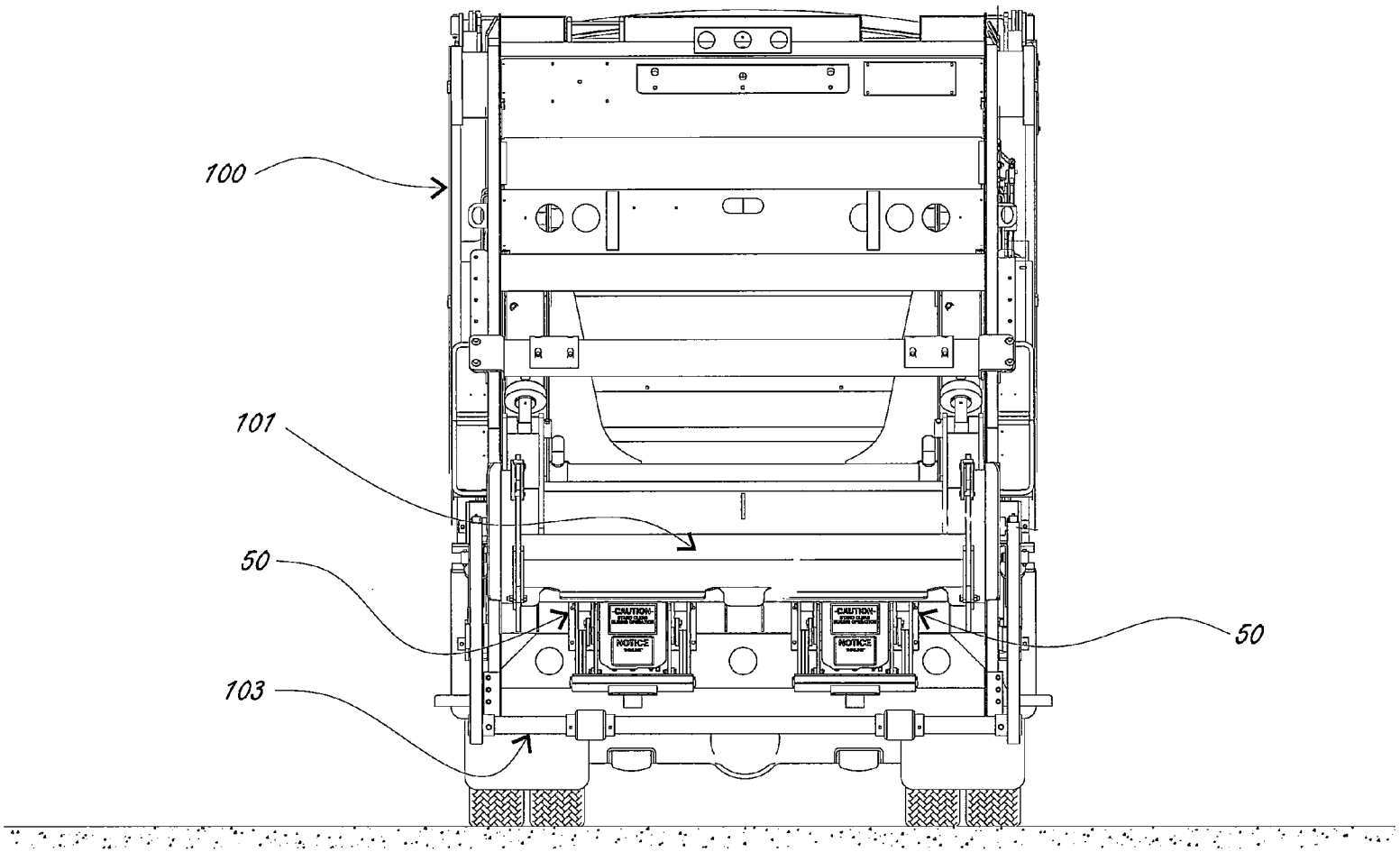
FIG. 19 is a front view of the rear of a rear-loading refuse collection vehicle showing two lifters in accordance with the present invention mounted to the rear of the refuse collection vehicle.

FIG. 19 depicts dual lifters 50 mounted to a refuse collection vehicle 100 just behind refuse hopper 101. As discussed previously, when refuse cart lifters 50 are operated to empty a refuse cart 104, lifting arms 54 will cause liftplate 55 to swing over and substantially inward of baseplate 51. This causes the opening 104*a* of refuse cart 104 to be located substantially forward of inner hopper edge 102 (not shown) when refuse cart lifter 50 is in the dumping position. This is best illustrated by examining FIGS. 20 and 21.

Figure 20:
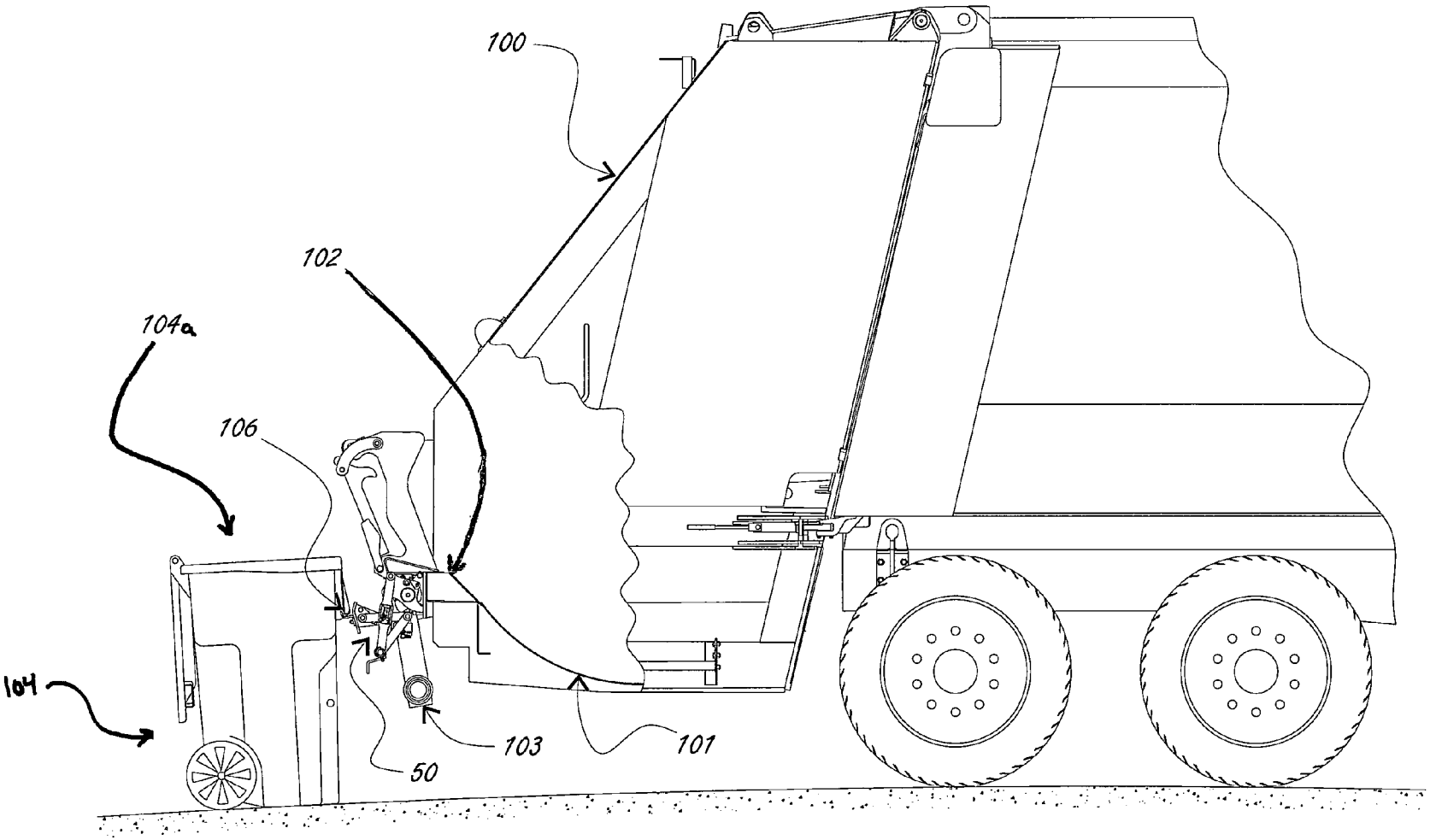
FIG. 20 is a partially cut away side view of an exemplary refuse cart lifter in accordance with the present invention shown in a retracted position and mounted on a rear-loading refuse collection vehicle.
Figure 21:
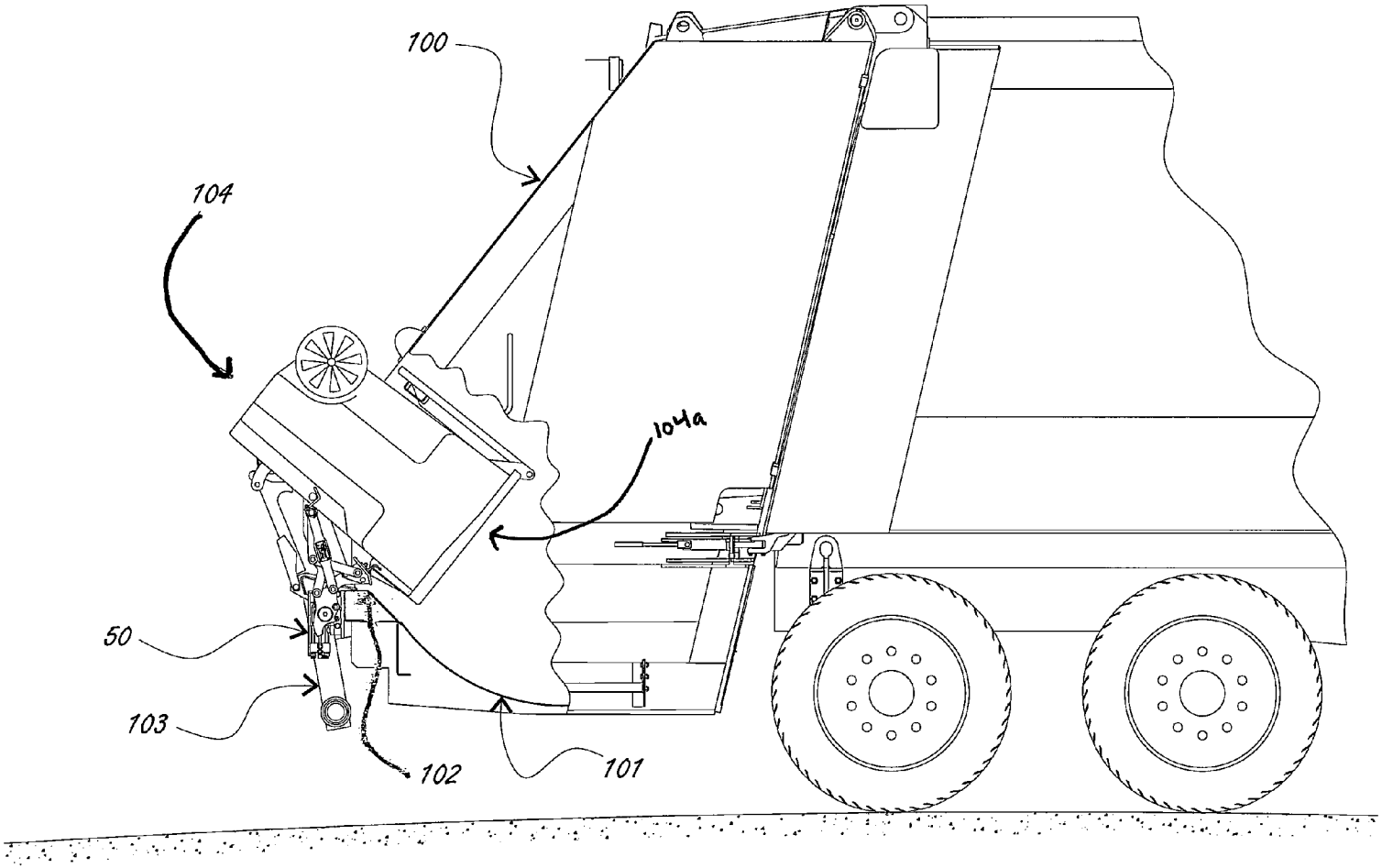
FIG. 21 is a partially cut away side view of an exemplary refuse cart lifter in accordance with the present invention shown in a dumping position and mounted on a rear-loading refuse collection vehicle.

FIG. 20 depicts a preferred embodiment of refuse cart lifter 50 shown in an intermediate position and attached to a partially cutaway view of refuse collection vehicle 100. Refuse cart lifter 50 is operated from the retracted position lifting refuse cart 104 by engaging upper lifting point 106 on uneven terrain. FIG. 21 depicts refuse cart lifter 50 in the dumping position, also offering a cutaway view of the refuse collection vehicle hopper 101 showing the opening 104*a* of refuse cart 104 located substantially forward of inner hopper edge 102. This results in the aforementioned reduction of compaction cycles since refuse is emptied further into the hopper as compared to conventional lifters.

Figure 22:
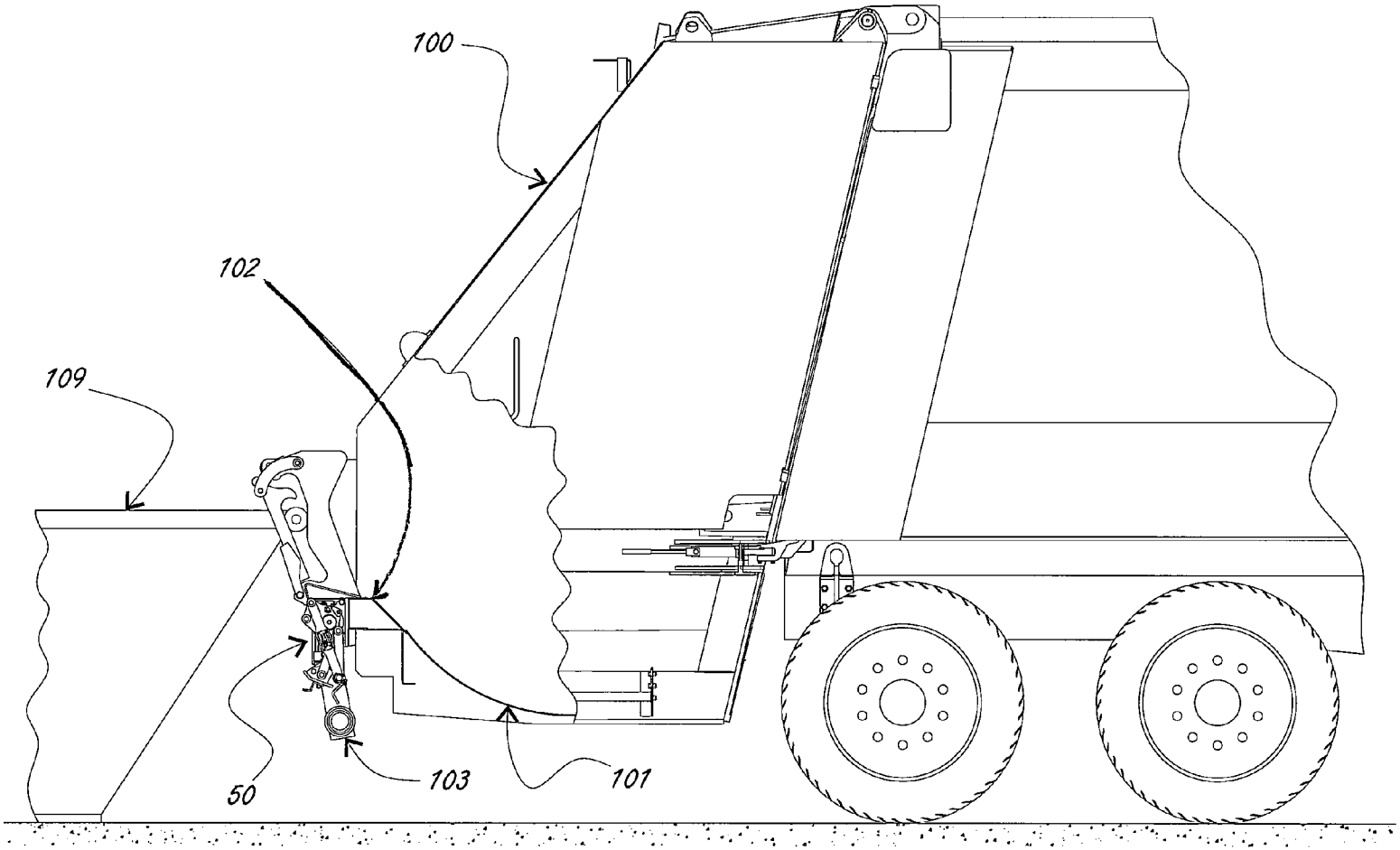
FIG. 22 is a partially cut away side view of an exemplary refuse cart lifter in accordance with the present invention shown in a retracted position and mounted on a rear-loading refuse collection vehicle. Also shown is a commercial container attached to the latch ears of the rear-loading refuse collection vehicle in the down position.
Figure 23:
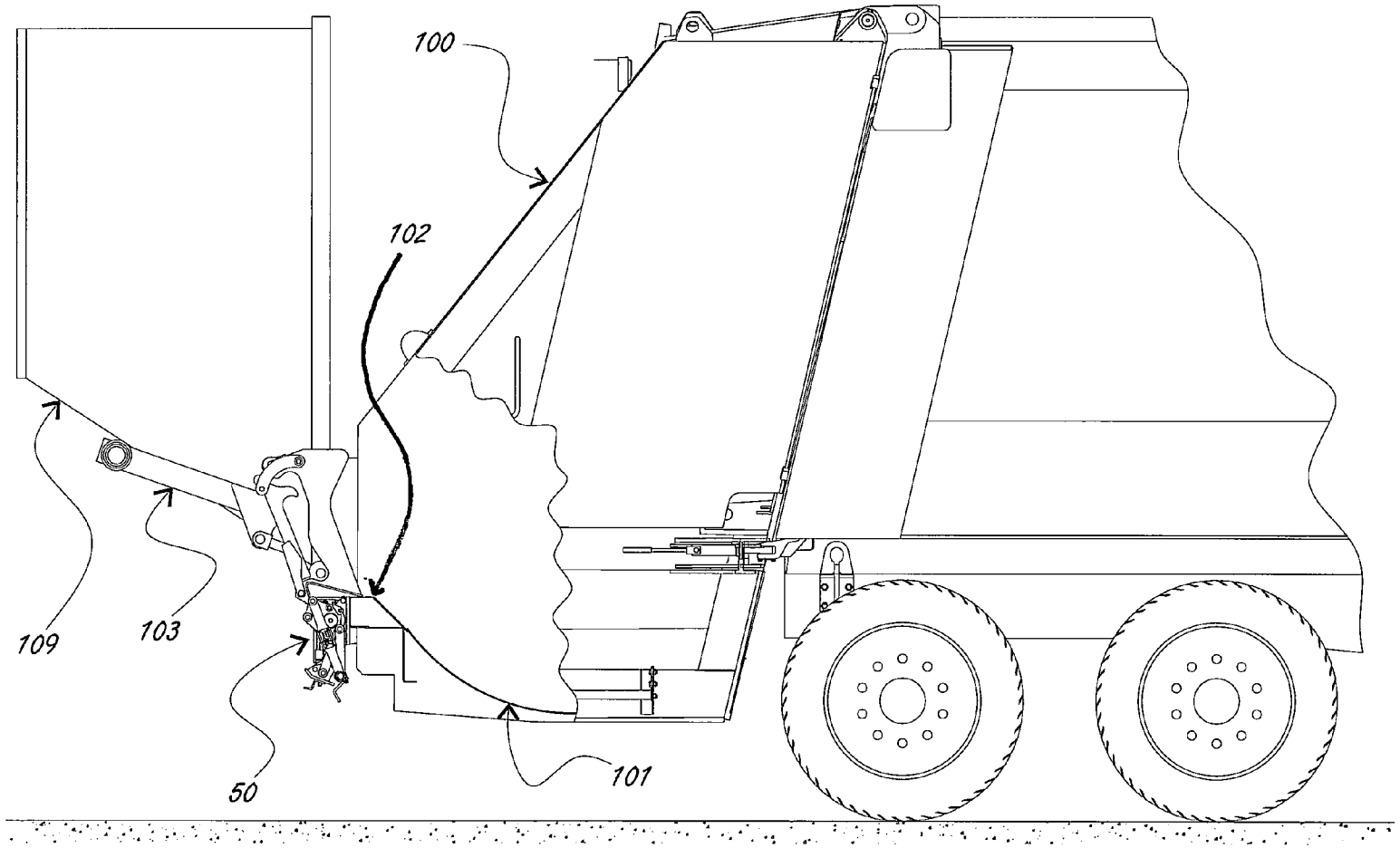
FIG. 23 is a partially cut away side view of an exemplary refuse cart lifter in accordance with the present invention shown in a retracted position and mounted on a rear-loading refuse collection vehicle. Also shown is a commercial container attached to the latch ears of the rear-loading refuse collection vehicle being rotated to the dump position by a roll bar.

FIG. 22 depicts a preferred embodiment of refuse cart lifter 50 shown in a retracted position and attached to a partially cutaway view of refuse collection vehicle 100. This figure emphasizes the compact profile of the lifter, which facilitates the dumping of large commercial container 109 using roll bar 103 to dump container 109 over retracted refuse cart lifter 50 as seen in FIG. 23.

The words used above are words of description rather than of limitation. Although preferred embodiments of the invention have been described using specific terms, devices, and methods, such description is for illustrative purposes only. It should be understood that aspects of the various embodiments may be interchanged either in whole or in part. Therefore, the spirit and scope of the appended claims should not be limited to the description of the preferred versions contained therein.

For example, a refuse cart lifter in accordance with this invention could utilize single arms or multiple arms. Furthermore, the lifter could be mounted to a variety of structures, including freestanding refuse containers, intermediate containers, rear-loading refuse collection vehicles, or side-loading refuse collection vehicles. Thus, it should be understood that changes and variations may be made by those of ordinary skill in the art without departing from the spirit or the scope of the present invention.

What is claimed is:

1. A method of emptying the contents of a refuse cart into a refuse collection vehicle with a refuse cart lifting device, the method comprising:

rotatably displacing a lift arm of the refuse cart lifting device, a first end of the lift arm being operably attached to a liftplate of the refuse cart lifting device, the second end of the lift arm being operably connected to an actuator;

rotatably displacing, by displacement of the lift arm, the liftplate from a recessed position to an intermediate position;

displacing a pivot plate and a hook arm of the refuse cart lifting device, the hook arm having a first end and a second end, the first end of the hook arm being operably attached to the pivot plate, the second end of the hook arm being operably attached to a shaft, the shaft being operably attached to a hook;

displacing a pull arm of the refuse cart lifting device as the liftplate is rotated to the intermediate position, the pull arm having a first end and a second end, the first end of the pull arm being pivotally attached to the liftplate;

displacing a push arm of the refuse cart lifting device, the push arm having a first end and a second end, the second end of the push arm being operably attached to the shaft;

engaging, during rotation of the liftplate to the intermediate position, a saddle on the liftplate with an upper lifting point on the refuse cart;

lifting, during rotation of the liftplate to the intermediate position, the refuse cart;

pivoting the hook into engagement with a lower lifting point on the refuse cart; and rotating the liftplate from the intermediate position to a dump position to empty the contents of the refuse cart into the refuse collection vehicle.

2. The method of claim 1, further including the step of actuating the actuator, the actuator being a dual rack, single pinion hydraulic actuator.

3. The method of claim 1, wherein the step of rotating the liftplate from a retracted position includes displacing the liftplate from a position below and behind the lifter baseplate, the lifter baseplate being operably connected to the refuse collection vehicle that is in front of the lifter baseplate.

4. The refuse cart lifting device of claim 3, wherein the step of rotating the liftplate from a retracted position further includes displacing the liftplate from a position in which the entire liftplate is located below and behind an inner edge of a hopper of the refuse collection vehicle and away from the refuse collection vehicle.

5. The refuse cart lifting device of claim 3, wherein the step of rotating the liftplate from a retracted position further includes displacing the liftplate from a position where the compact refuse cart lifting device was positioned to permit the emptying of large commercial refuse containers into the refuse collection vehicle.

6. The method of claim 1, further including the step of pivotally displacing an idler arm, the idler arm having a first end and a second end, the first end of the idler arm being pivotally attached to the pivot plate, the second end of the idler arm being pivotally attached to first end of the push arm and pivotally attached to the second end of the pull arm.

7. The method of claim 1, wherein the displacement of the pivot plate is independent of the displacement of the lift arm, the pivot plate being pivotally mounted on the lift arm.

* * * * *